US005739796A

United States Patent [19]

Jasper, Jr. et al.

[11] Patent Number: 5,739,796

[45] Date of Patent: Apr. 14, 1998

[54] ULTRA-WIDEBAND PHOTONIC BAND GAP CRYSTAL HAVING SELECTABLE AND CONTROLLABLE BAD GAPS AND METHODS FOR ACHIEVING PHOTONIC BAND GAPS

[75] Inventors: Louis J. Jasper, Jr., Fulton, Md.; Lawrence Carin, Chapel Hill, N.C.; K. Ming Leung, Fort Lee, N.J.

[73] Assignee: The United States of America as represented by the Secretary of the Army, Washington, D.C.

[21] Appl. No.: 550,040

[22] Filed: Oct. 30, 1995

[51] Int. Cl.[6] ..... H01Q 1/36

[52] U.S. Cl. ..... 343/895; 343/785; 343/787; 343/909; 333/202

[58] Field of Search ..... 343/700 MS, 701, 343/895, 785, 787, 909; 333/202

[56] References Cited

U.S. PATENT DOCUMENTS

| | | | |
|---|---|---|---|
| 4,090,204 | 5/1978 | Farhat | 343/754 |
| 5,357,260 | 10/1994 | Roederer et al. | 343/754 |
| 5,386,215 | 1/1995 | Brown | 343/795 |
| 5,389,943 | 2/1995 | Brommer et al. | 343/909 |
| 5,410,284 | 4/1995 | Jachowski | 333/202 |
| 5,471,180 | 11/1995 | Brommer et al. | 333/202 |
| 5,541,613 | 7/1996 | Lam et al. | 343/792.5 |
| 5,546,059 | 8/1996 | Yorita et al. | 333/202 |

OTHER PUBLICATIONS

E.R. Brown, "Photonic–Crystal Planar Antenna," 1993 Army Research Office Highlights.

K.M. Leung et al, "Calculations of Dispersion Curves and Transmission Spectrum of Photonic Crystals: Comparisons with UWB Microwave Pulse Experiments", Ultra–Wideband, Short–Pulse Electromagnetics 2, pp. 331–340, Plenum Press, New York and London, Dec. 1994.

"Microwave Hardening Design Guide For Systems", HDL–CR–92–709–6, vol. 2, Apr., 1992.

*Primary Examiner*—Donald T. Hajec
*Assistant Examiner*—Tan Ho
*Attorney, Agent, or Firm*—Michael Zelenka; George B. Tereschuk

[57] ABSTRACT

The present invention provides multidimensional stacked photonic band gap crystal structures improving the performance of current planar monolithic antennas and RF filters by forbidding radiation from coupling into the substrate thereby significantly enhancing radiation efficiency and bandwidth. This invention comprises a number of sub-crystals with each having at least two lattices disposed within a host material, each lattice having a plurality of dielectric pieces arranged and spaced from each other in a predetermined manner, the sub-crystals being stacked in a crystal structure to provide a photonic band gap forbidding electromagnetic radiation propagating over a specially designed frequency band gap, or stopband. Both two dimensional and multidimensional crystals are disclosed. The preferred embodiment is a three-dimensional photonic band gap crystal comprising two or more sub-crystals, with each sub-crystal having a diamond-patterned lattice constructed from a plurality of dielectric zigzag pieces orthogonally interconnected, disposed within a host material.

64 Claims, 6 Drawing Sheets

ULTRA-WIDEBAND PHOTONIC BAND GAP CRYSTAL HAVING SELECTABLE AND CONTROLLABLE BAD GAPS AND METHODS FOR ACHIEVING PHOTONIC BAND GAPS

GOVERNMENT INTEREST

The invention described herein may be manufactured, used and licensed by or for the Government of the United States of America without the payment to us of any royalties thereon.

BACKGROUND OF THE INVENTION

1. Field of the Invention

The present invention relates to the field of antennas and RF filters and more particularly to ultra-wideband photonic band gap crystal antennas and radio frequency (RF) filter devices.

2. Description of the Prior Art

The photonic crystal is a periodic high-permittivity dielectric structure whose electromagnetic (EM) dispersion relation has a band structure similar to that of electrons in crystalline solids. They can be made to exhibit a forbidden range of frequencies, or band gap, in their dispersion relationship, making the photonic crystal well-suited for substrates for planar, monolithic antennas and RF filters.

While monolithic antennas are commonly used in integrated circuits and typically employ a dielectric substrate for structural support, they suffer from the significant drawback that direct radiation into the dielectric substrate is much stronger than into air and thus they exhibit a low-coupling efficiency to free space, as well as parasitic electromagnetic coupling to other circuit devices which can cause significant undesired cross-talk and noise. Up to now, there is no monolithic antenna device which operates suitably without suffering from the drawback of radiation trapping within the substrate.

Narrow bandwidth photonic band gap antennas have been demonstrated and are discussed in R. Brown, "Photonic-Crystal Planar Antenna," a 1993 Army Research Office Highlights publication, describing a bow-tie antenna fabricated on a three-dimensional photonic crystal. Heretofore they have been limited by narrowband characteristics. Three-dimensional photonic crystals utilize a common forbidden band gap with respect to electromagnetic wave polarizations and are typically fabricated with holes, or air voids, at the points of the Bravais Lattice. FIG. 1 depicts the prior art bow-tie antenna mounted on a three-dimensional photonic crystal substrate, as well as an experimental setup used to measure radiation patterns at 13.2 GHz. FIG. 2 compares the radiation pattern at 13.2 GHz measured over 360° for the bow-tie antenna mounted on a photonic band gap crystal with the radiation pattern on a uniform dielectric substrate. FIG. 2 demonstrates that nearly all of the electromagnetic energy was radiated into free space using the photonic crystal substrate, while the bow-tie antenna configuration exhibits a narrowband, or bandwidth spectrum of only about 10% to 20%. Up to now, photonic band gap antennas were limited by the narrowband characteristic demonstrated in FIG. 1.

Current dielectric substrates used in antennas and RF filters are cumbersome and a more compact crystal substrate would be advantageous because physical size of the antenna, irrespective of the type of planar antenna or crystal substrate utilized, is inversely proportional to the effective refractive index $$N=\left[\frac{(1+\epsilon_{eff})}{2}\right]^{\frac{1}{2}}$$

where $\epsilon_{eff}$ is the effective permittivity of the photonic crystal. Photonic crystals usually have large amounts of a host material, which is often air, interspersed with small regions of much higher dielectric constant material. For such photonic crystals, $\epsilon_{eff}$ is very close to the dielectric constant of the host material, air. Achieving a high contrast between the host material and the higher dielectric material is extremely advantageous because the depth of the forbidden band gap is increased, in effect rejecting more electromagnetic energy from the photonic crystal. Thus one could use a high dielectric host material interspersed with an even higher dielectric material, to achieve more compact photonic crystals. This is advantageous at lower microwave frequencies, below the S band, where photonic crystals tend to be more bulky.

For example, this contrast could be achieved by using dielectric materials with $\epsilon_r=12$ and $\epsilon_r=200$, with the effective dielectric constant $\epsilon_{eff}$ now being closer to 12, instead of close to 1. Therefore, it is now possible to have a photonic band gap antenna and substrate appreciably more compact than current, equivalent devices. At higher frequencies in the millimeter region, the ground plane for circuits printed on ceramic substrates becomes increasingly closer to the circuit which causes losses. The present invention eliminates this problem because photonic band gap substrates have no ground plane.

RF filter designs are closely related to antenna performance because they allow the designed RF spectra to pass through the filter with low insertion loss and also filter unwanted RF signals. They protect a system from RF threat environments by employing them upstream from the critical components in front door paths where antennas are utilized as the receptors of RF signals. A reference on filters is the "Microwave Hardening Design Guide For Systems", HDL-CR-92-709-6, vol 2, April 1992. Filter selection and design depends on both system requirements and the anticipated RF environment. Since the filter's purpose is to reflect or absorb signals outside the system's intended operating bandwidth, center frequency (for pass-band filters), bandwidth, and insertion loss are important filter characteristics, but no current RF filters provide the much-needed capability for multi-functional selectivity. While RF hardening techniques have been useful at the antenna or optical port for some systems, that approach also suffers from the drawback of not knowing the parameters of the RF threat environment. Current hardening techniques do not have simultaneous frequency, time, spacing and polarization selectivity.

The present invention overcomes the limitations, drawbacks, problems and difficulties with current monolithic and photonic band gap antennas, as well as RF filters, in terms of radiation efficiency, narrow bandwidths and lack of selectivity as regards frequency, time, spacing and polarization parameters by providing multidimensional stacked photonic band gap crystal structures which improve the performance of current planar monolithic antennas and RF filters by forbidding radiation from coupling into the substrate thereby significantly enhancing radiation efficiency and bandwidth.

In general, the present invention is a number of sub-crystal structures with each structure having at least two lattices disposed within a host material, each lattice having a plurality of dielectric pieces advantageously arranged in a plurality of rows, with the pieces and rows of each lattice being spaced from each other in a predetermined manner, the sub-crystal structures being stacked to provide a photonic band gap forbidding electromagnetic radiation to propagate over a specially designed frequency band gap, or stopband. The present invention encompasses both two dimensional and multidimensional lattices with the dielectric pieces being shaped as either circular rods, rectangular rods, zigzag pieces or otherwise.

The multidimensional stacked photonic band gap crystal structures of the present invention would be extremely useful in applications requiring very efficient radiation of greater than 90% into free space, a bandwidth greater than an octave, compactness, back and side lobes reduction, and in some cases simultaneous multiple selectivity of frequency, time, spatial and polarization (FTSP) parameters.

The present invention offers numerous performance advantages not heretofore available. For example, an antenna made to operate over a wide bandwidth and have selective narrow transmit and receive bands inside the wideband spectrum. Another example is a filter for a frequency hopping system designed to have selective transmit and receive bands that change in synchronization with the frequency hopping scheme because unwanted signals could be more effectively filtered in frequency hopping communications systems.

Additionally, methods of making multidimensional stacked photonic band gap crystal structures are also disclosed.

References on photonic band gap antennas are:

E. R Brown, "Photonic-Crystal Planar Antenna," 1993 Army Research Office Highlights; and K. M. Leung et. al., "Calculations of Dispersion Curves and Transmission Spectrum of Photonic Crystals: Comparisons With UWB Microwave Pulse Experiments" Ultra-Wideband, Short-Pulse Electromagnetics 2, pp. 331–340, Plenum Press, New York and London, December 1994.

References on filters are:

"Microwave Hardening Design Guide For Systems", HDL-CR-92-709-6, vol. 2, April, 1992.

SUMMARY OF THE INVENTION

It is an object of this invention to provide ultra wideband photonic band gap crystals suitable for antennas and RF filter structures.

It is another object of the present invention to provide a two-dimensional ultra wideband photonic band gap crystal composed of dielectric pieces which when interfaced with an antenna radiates very efficiently into free space, has a bandwidth greater than an octave and is compact.

It is a further object of the present invention to provide a three-dimensional photonic band gap crystal composed of zigzag dielectric pieces which when interfaced with an antenna radiates very efficiently into free space, has a bandwidth greater than an octave and is compact.

It is an additional object of the present invention to furnish a two-dimensional Frequency, Time, Spatial and Polarization ("FTSP") parameter tunable photonic band gap crystal composed of dielectric, ferroelectric pieces that provides an ultra-wideband band gap exhibiting a bandwidth greater than an octave, compactness and the ability to select parameters relating to frequency, time, spatial and polarization.

It is still another object of the present invention to provide a three-dimensional FTSP tunable photonic band gap crystal with zigzag ferroelectric pieces which provides an ultra-wideband band gap exhibiting a bandwidth greater than an octave, compactness and the ability to select parameters relating to frequency, time, spatial and polarization.

It is still a further object of the present invention to provide methods of making multidimensional stacked photonic band gap crystals.

To attain these and other objects, the present invention contemplates a plurality of sub-crystals with each having different dimensions and a plurality of lattices disposed within a host material. Each lattice having a number of dielectric pieces advantageously arranged in rows, with the pieces having the same dimension within a lattice, and the pieces and the rows of each lattice being spaced from each other in a predetermined manner in order to provide one of the plurality of sub-crystals. The plurality of sub-crystals being stacked to provide a photonic band gap forbidding electromagnetic radiation to propagate over a specially designed frequency band gap, or stopband. The present invention encompasses both two dimensional and multidimensional lattices with the dielectric pieces shaped as either circular rods, rectangular rods or zigzag pieces.

In the first embodiment, the present invention provides a two-dimensional ultra wideband photonic bandwidth crystal comprising at least two sub-crystal structures, each having a lattice disposed within a host material, the first sub-crystal having a plurality of dielectric rods of the same dimension arranged in parallel rows and columns, with the rods having predetermined dimensions and the rows and columns being spaced from each other in a predetermined manner, the second sub-crystal having a second plurality of differently dimensioned dielectric rods, all of the second plurality of dielectric rods being of the same dimension, arranged in a plurality of parallel rows and columns, with the rows and columns of the second sub-crystal being spaced from each other in a predetermined manner, both sub-crystals comprising a crystal structure, a plurality of crystal structures being stacked to provide a wideband photonic band gap for TE waves, an electric field parallel the rods, propagating normal to the rod axis, which also achieves a smaller band gap for TM waves.

The preferred embodiment is a three-dimensional photonic band gap crystal comprising two or more sub-crystal structures, with each sub-crystal structure having a diamond-patterned lattice having a plurality of dielectric zigzag pieces orthogonally interconnected, disposed within a host material, forming a sub-crystal structure. A crystal structure having a plurality of such sub-crystal structures stacked with each sub-crystal structure composed of dielectric zigzag pieces of predetermined dimensions which are different for each sub-crystal and stacked to provide a wideband photonic band gap crystal exhibiting a common forbidden gap with respect to both polarizations.

The third embodiment is a variation of the first embodiment having a similar configuration of lattices, however in the third embodiment ferroelecrtric, dielectric rectangular cross-sectional rods coated on two sides with a thin layer of conducting material provide a two-dimensional, tunable Frequency, Time, Space and Polarization ("FTSP") parameter selective photonic band gap crystal. The fourth embodiment is a three-dimensional FTSP selective photonic band gap crystal comprising two or more parallel lattices of ferroelectric, dielectric pieces in a zigzag, diamond pattern, similar to the configuration of the preferred embodiment, with the ferroelectric pieces being coated on two sides with conducting material to provide an ultra-wideband (UWB)

band gap having the ability to select parameters relating to frequency, time, spatial and polarization. Both the third and fourth embodiments utilize rectangular, cross-sectional ferroelectric rods and zigzag pieces coated with conducting material and they provide tuneable crystals for RF filters and antenna substrates.

The materials and shapes used in constructing the dielectric pieces can vary, and in some cases the pieces can be either strictly dielectric or have both dielectric and ferroelectric properties allowing different arrangements and properties.

BRIEF DESCRIPTION OF THE DRAWINGS

Other features and details of the present invention will become apparent in light of the Detailed Description of the Invention and the accompanying figures.

Table I lists candidate ceramic materials along with their respective dielectric constants and loss-tangents which are suitable for fabricating photonic band gap crystals.

Table II lists the electronic properties of candidate ferroelectric materials suitable for fabricating the ferroelectric, dielectric pieces suitable for use in photonic band gap crystals.

DETAILED DESCRIPTION OF THE INVENTION

As described in the Background of the Invention, those concerned with monolithic and photonic band gap antennas and RF filters have long recognized the drawbacks and limitations of current devices in terms of internal radiation trapping, narrow bandwidths, lack of FTSP selectivity and cumbersomeness. At low frequencies, i.e. the L, S and C bands, cumbersomeness is reduced by using materials having a high dielectric constant greater than 100. At high frequencies, such as above the C band, cumbersomeness is not a problem, but having the ground plane too close to the circuit can be a serious concern. Since photonic band gap structures have no ground plane, this problem is eliminated. Numerous prior limitations and drawbacks are eliminated by this invention.

The first and second or preferred embodiments provide an ultra wideband photonic band gap crystal structure which can be used as a filter with a either fixed stopband or which can be coupled to an antenna circuit to produce a monolithic ultra wideband antenna device, while the third and fourth embodiments provide an ultra wideband photonic band gap crystal with frequency, time, spatial and polarization selectivity for RF filter devices and substrates for an antenna.

Figure 1:
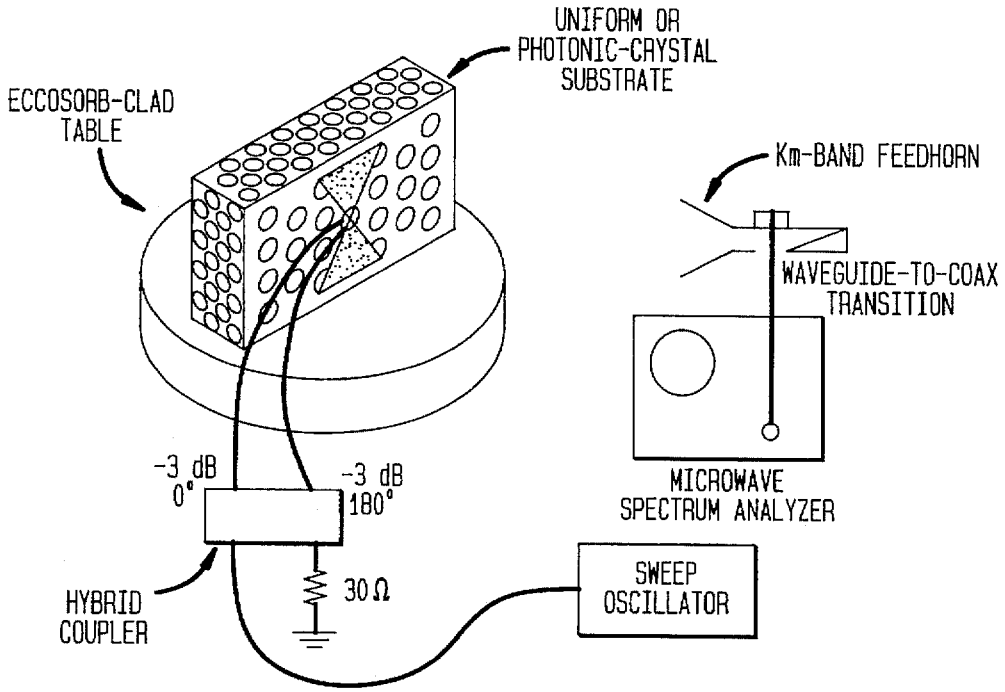
FIG. 1 (PRIOR ART)
FIG. 1 depicts the prior art three-dimensional photonic crystal bow-tie configuration.
Figure 2:
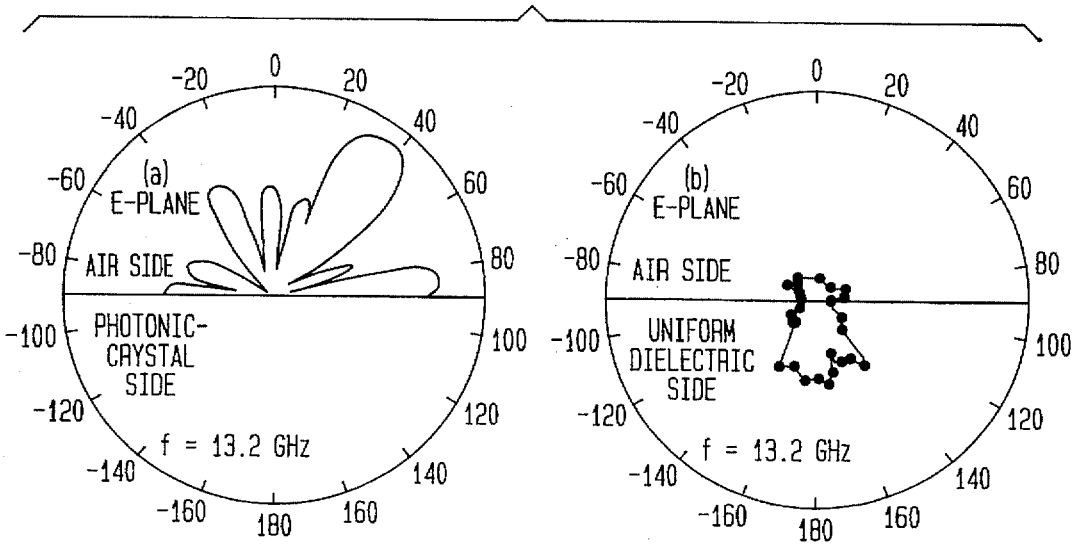
FIG. 2 compares the radiation pattern for the bow-tie antenna on a uniform dielectric substrate with the radiation pattern of a photonic band gap crystal.
Figure 3:
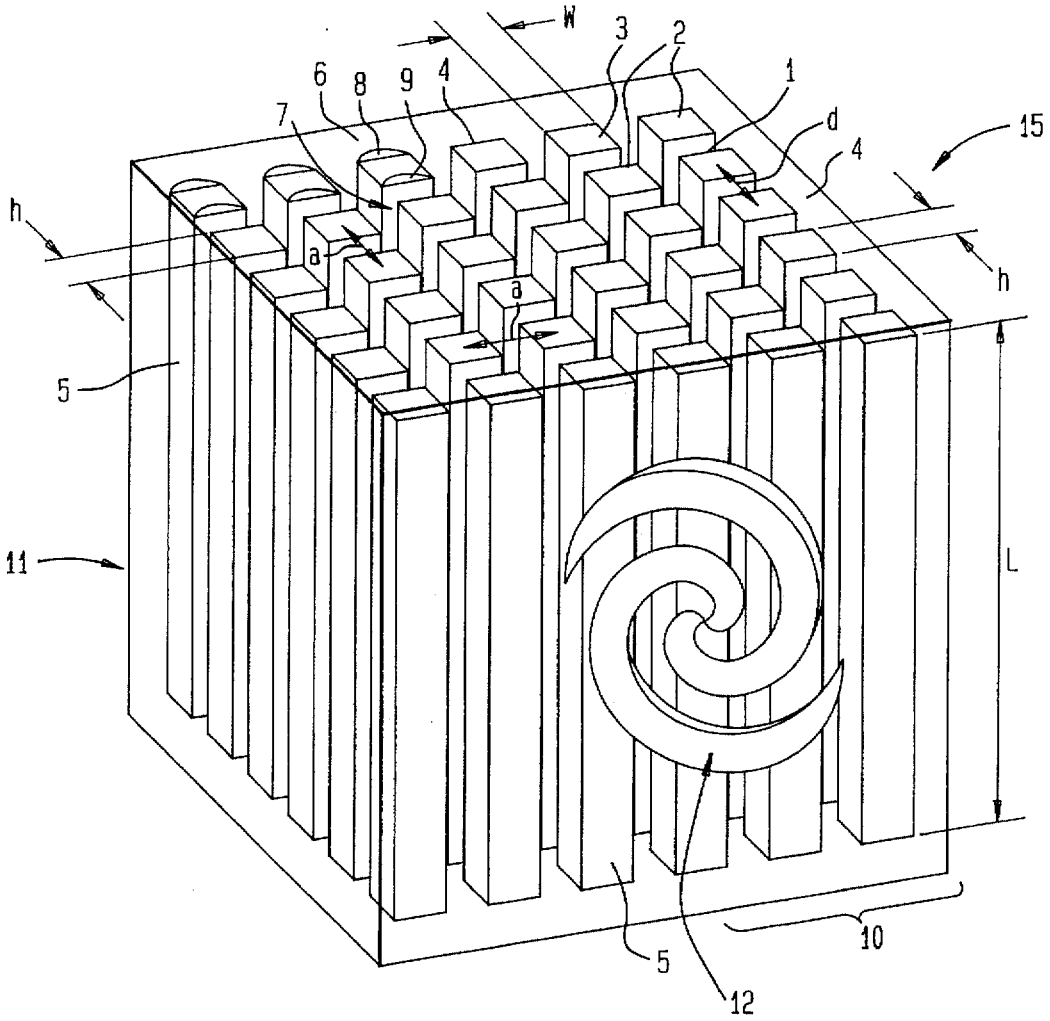
FIG. 3 is a perspective view of one sub-crystal of the non-tuneable two dimensional photonic bad gap crystal which is the first embodiment of the present invention.

Referring now to the drawings, FIG. 3 depicts the first embodiment of the present invention comprising a two-dimensional photonic band gap sub-crystal. In this embodiment, the use of dielectric/ferroelectric materials with a high refractive index reduces crystal dimensions while a high contrast between the dielectric material and other host material increases the depth of the band gap. A first plurality of N equal length dielectric rods 2 are disposed within a host material 11 into a first row 1 by aligning N rods with a square cross-sectional dimension, W, with constant spacing, d, indicated by a double-pointed arrow between each of the rods 2 within said first row 1. A second plurality of N equal length dielectric rods 2, having said cross-sectional dimension, W, also being disposed within said host material 11 into a second row 3, said second row 3 being in parallel with said first row 1, said second row 3 being at a distance, d, from said first row 1, with the rods 2 of said second row 3 being spaced between each in the same fashion as the rods 2 of said first row 1. A third plurality of identically dimensioned dielectric rods 2 is disposed in a third row 4 within said host material 11 in the same manner. Disposing said pluralities of dielectric rods within said host material 11 in this manner provides a first sub-crystal 10 having a rod axis and being capable of producing a stopband with more than a 20% bandwidth.

A second sub-crystal is constructed in a similar manner to said first sub-crystal 10 by having a plurality of N dielectric rods with a second constant square cross-sectional dimension, W/2, and a second constant inter-rod spacing, d/2 and said rod axis. The parallel stacking of said first sub-crystal 10 and said second sub-crystal, respectively, produces a crystal 15 having an octave band gap. The stacking of said sub-crystals results in the larger bandwidth structure providing the photonic band gap crystal of the first embodiment of the present invention. Other FIG. 3 references pertain to features of the third embodiment and will be described in connection with that embodiment.

In this embodiment, said first and second sub-crystals are stacked in parallel on top of each other and radiation efficiency is achieved by matching the antenna response to the band gap of the photonic crystal. Additionally, in the first embodiment the two-dimensional photonic crystal being constructed of said first and second pluralities of dielectric rods, respectively, in at least said two sub-crystals, produces a photonic band gap for TE waves, an electric field parallel to said pluralities of dielectric rods, propagating normal to the rod axis, which also achieves a smaller band gap for TM waves.

Said crystal structure may be coupled with an antenna such as a spiral antenna 12 with equiangular arms and a signal generating means in order to provide a monolithic ultra wideband antenna. It is necessary for said signal generating means to be an ultra wideband generator for the circuit to achieve an ultra wideband response. "Additionally, said crystal structure may also act as a filter."

Figure 4:
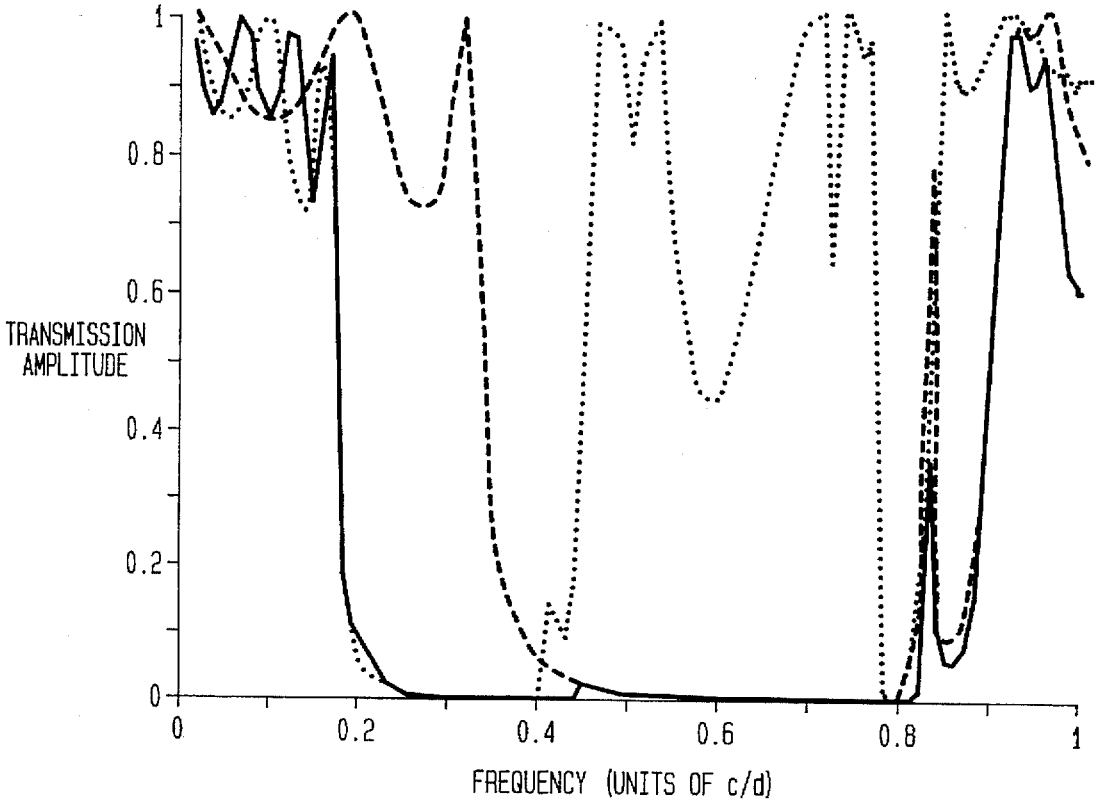
FIG. 4 is a computer-generated plot of the transmitted amplitude versus frequency for a TE polarized wave incident normal upon the FIG. 3 photonic band gap crystal.

Referring now to FIG. 4, which is a computer-generated plot of the transmitted amplitude versus frequency for a TE polarized wave incident normal upon the FIG. 3 photonic band gap crystal, there is shown the theoretical field amplitude transmitted through the $\epsilon_r$=49, index refraction of N=7, dielectric rod, photonic band gap crystal of the present invention. In FIG. 4, the dashed curves correspond to transmission through said two separate sub-crystals. It is noted that the two sub-crystals have stopbands, or a zero transmitted field, over complementary portions of the electromagnetic spectrum, and that the composite structure has a stopband represented by the solid curve covering a bandwidth greater then an octave, or 200–800 MHz. The results depicted show a TE polarized plane wave, having its electrical field parallel to the rod axes, incident normally. Similar results have been experienced for oblique incidence and for TM polarization.

In the FIG. 4 example, both center frequency and bandwidth can be determined for a value of d and W=0.12 d. Also note that the FIG. 4 example has $\epsilon_r$=49 for said plurality of dielectric rods and $\epsilon_r$=1 for said host material, where the square root of the ratio is 7, which is the contrast of said photonic crystal. Comparison sizes for other photonic crystals can be determined from the effective refractive index and the effective permittivity of said photonic crystal. For example, if said host material 11 is alumina, shown in Table I, then the size of the photonic crystal would be reduced as follows:

$$\sqrt{\frac{\epsilon_r(\text{alumina})}{\epsilon_r(\text{air})}}=\sqrt{\frac{9.5}{1}}\approx 3$$

In this example, a high dielectric material such as MCT-140 could be used to achieve both a higher $\epsilon_{eff}$ and a 3.8 contrast for the photonic crystal. A higher contrast results in a deeper stopband.

In the first embodiment, an ultra wideband generator may be obtained in various ways, including picosecond optical systems to switch planar antennas photoconductively. Optical pulses with picosecond time durations may also have simultaneous bandwidths of several octaves.

Figure 10:
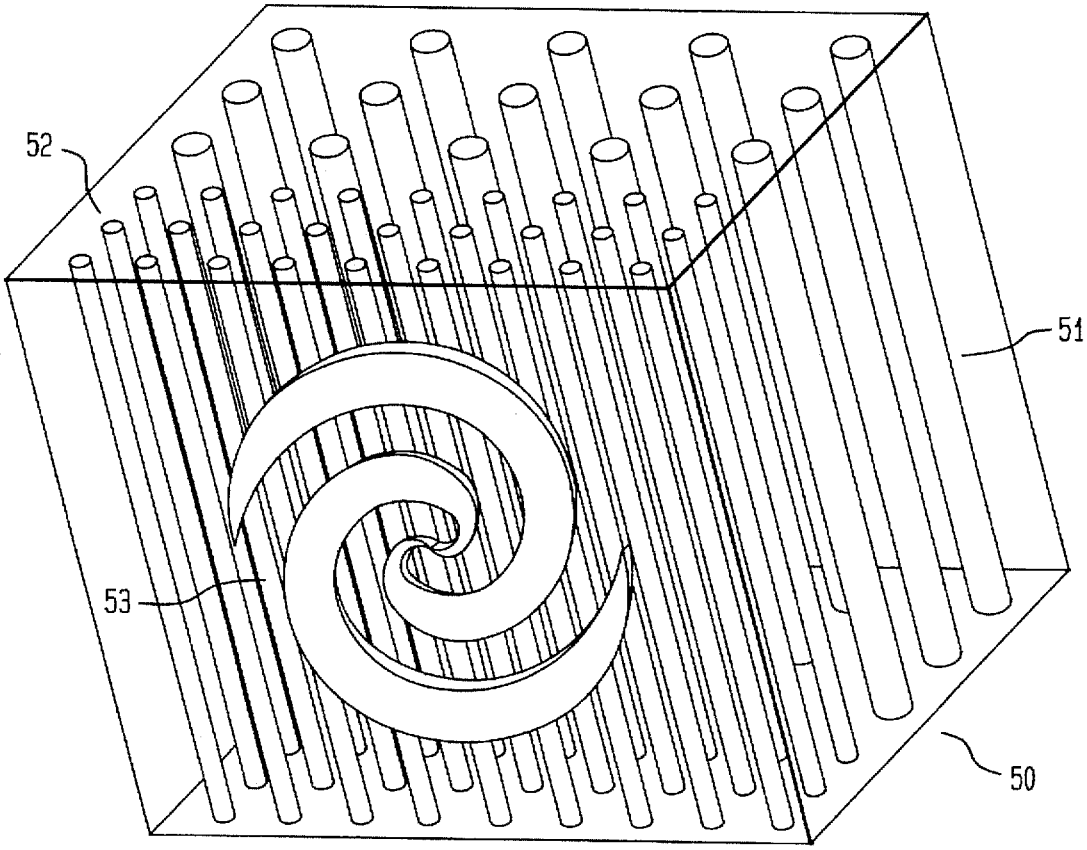
FIG. 10 is a perspective view of a variation of the first embodiment of the present invention depicting the non-tunable two-dimensional photonic band gap crystal with a first and second plurality of rods each having a circular cross-section.

Said crystal 15 may be fabricated by drilling out cylinders within said host material 11 and then inserting said first and second pluralities of dielectric rods into the hollowed-out cylinders. Also, instead of inserting said first and second pluralities of dielectric rods into cylinders, one skilled in the art could insert a mass of dielectric powder into the hollowed-out areas and, using centrifugal force, compact the dielectric powder into a group of high-density rods having either square, rectangular, circular or elliptical cross-sections. Referring now to FIG. 10, there is depicted a perspective view of a variation of the first embodiment of the present invention depicting the non-tunable two-dimensional photonic band gap crystal 50 with a first and second plurality of rods 51 and 52, respectively, each having a circular cross-section, and a spiral antenna 53 with equiangular arms. Pluralities of elliptically-shaped rods are also encompassed by this embodiment and would be configured within the crystal in a manner similar to that shown in FIG. 10.

Table I lists candidate dielectric materials, along with their dielectric constants and loss-tangents which can be used to construct said first and second pluralities of dielectric rods as well as said dielectric host material 11. The materials have low loss-tangents and dielectric constants ranging from 4.5 to 100.

Table II is a list of suitable ferroelectric materials which may also be utilized in constructing a photonic crystal. Referring back to Table I, a high dielectric contrast between said first and second pluralities of dielectric rods and said host material 11 is significant. Additionally, using dielectric materials with loss tangents of $\epsilon''/\epsilon'$ affects the ability of said photonic crystal to reflect electromagnetic energy. Table I shows that as $\epsilon'$, or $\epsilon_r$, increases, $\epsilon''$, also increases. Those skilled in the art will recognize the power, frequency and size tradeoffs involved with various different dielectric material properties and geometries.

Figure 5:
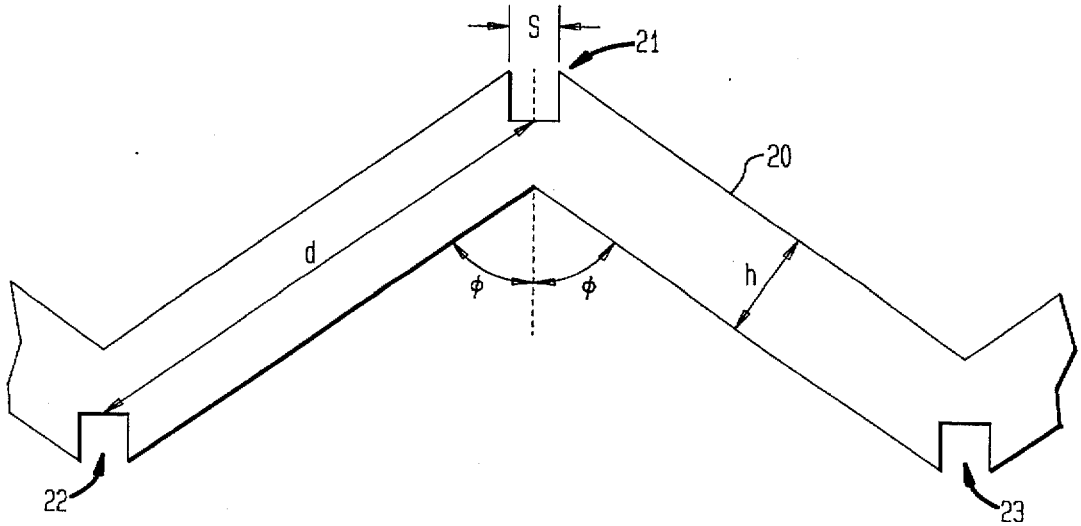
FIG. 5 is an exploded front view of a single zigzag piece utilized in the preferred embodiment of the present invention, which is stacked and arranged with additional pieces to form the diamond configuration of the three-dimensional photonic band gap crystal depicted in FIG. 7.
Figure 6:
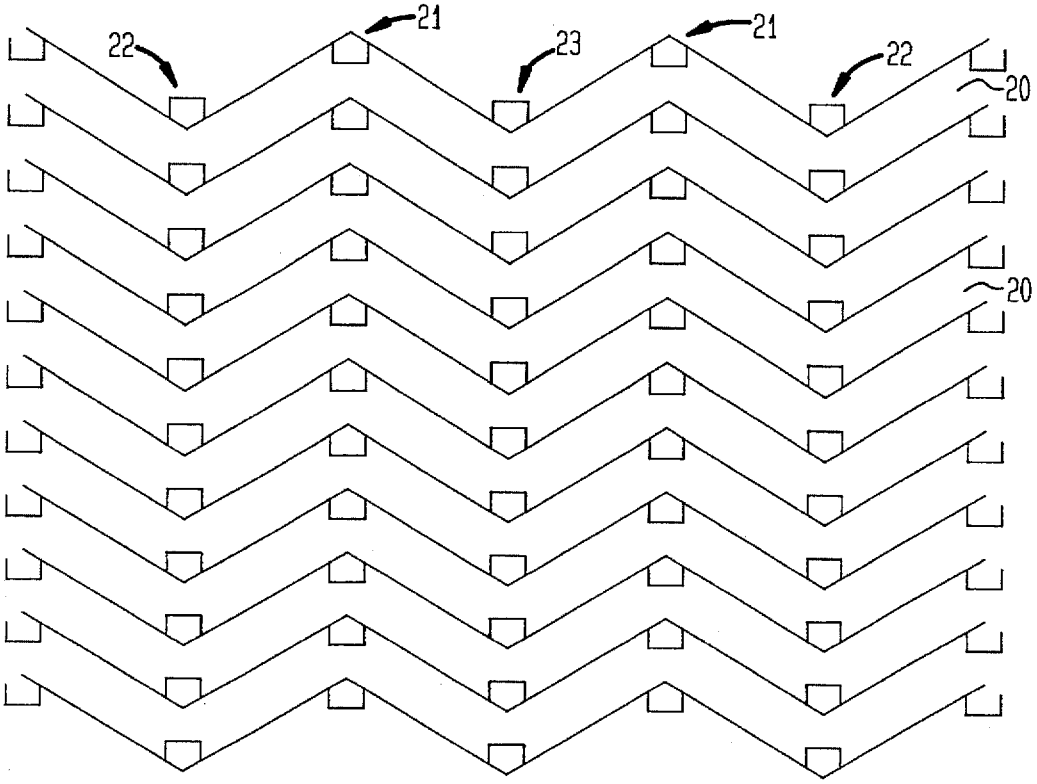
FIG. 6 is a top view of a sheet of high dielectric material depicting a number of zigzag pieces utilized in the preferred and fourth embodiments of the present invention for the three-dimensional zigzag, diamond-shaped configuration of the lattices.
Figure 7:
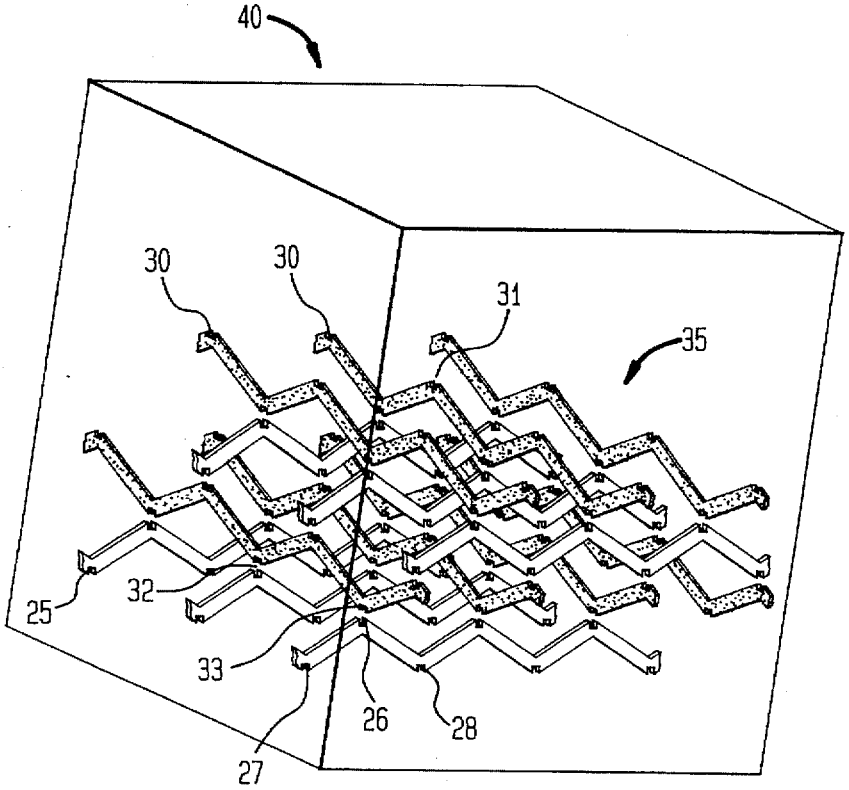
FIG. 7 is a perspective view of the preferred embodiment of the present invention depicting the three-dimensional zigzag diamond-shaped configuration of only one sub-crystal within a crystal structure.

FIGS. 5–7 depict several aspects of the preferred embodiment of the present invention comprising a three-dimensional photonic band gap crystal composed of two or more sub-crystal structures, each structure having a diamond-patterned lattice, disposed within a host material, each diamond-patterned lattice having a plurality of dielectric zigzag pieces with different dimensions for each sub-crystal, orthogonally interconnected, the sub-crystal structures exhibiting a common forbidden gap with respect to both polarizations when a plurality of such sub-crystal structures are stacked on top of each other in a crystal structure in order to provide a wideband photonic band gap crystal.

FIG. 5 depicts a single zigzag dielectric piece, FIG. 6 depicts numerous dielectric zigzag pieces outlined on a single sheet of dielectric material and FIG. 7 depicts a number of such dielectric zigzag pieces being orthogonally interconnected into a diamond patterned lattice used to construct the three-dimensional photonic band gap crystal.

Referring now to FIG. 5, an exploded front view of a single dielectric zigzag piece 20 utilized in this embodiment as well as its dimensions is provided. Said dielectric zigzag piece 20 having a plurality of upper notches 21 and a plurality of lower notches 22 and 23, respectively, all having a same width, w. The dimension, d, for the linear distance between said upper notch 21 and said lower notch 22 is derived from the formula:

$$d=a\frac{3}{16}^{\frac{1}{2}}$$

and the center frequency of operation is:

$$f=\frac{0.6c}{a}$$

where c is the speed of light in a vacuum. For dielectric materials having an index of refraction between 3 to 4, $$\frac{t}{a}\approx 0.24\frac{w}{a}\approx 0.16$$

in order to achieve a diamond structure where $\phi\approx 54.74°$. The thickness, t, of said dielectric zigzag piece 20 equals the width, w, of each of said notches 21–23, respectively, making each of said dielectric zigzag pieces 20 orthogonally interconnectable with another.

FIG. 6 shows a top view of a sheet of high dielectric material. This sheet depicts a large quantity of said plurality of dielectric zigzag pieces 20 arranged on it in order to mass produce them, each of said dielectric zigzag pieces 20 having said plurality of upper notches 21 and said plurality of lower notches 22 and 23, respectively, with the dimensions depicted in FIG. 5.

Referring now to FIG. 7, which is a perspective view of the preferred embodiment, a first plurality of dielectric zigzag pieces 25 is shown orthogonally interconnecting with a second plurality of dielectric zigzag pieces 30, which, for ease of illustration, are darkened. Both said first and second plurality of dielectric pieces 25 and 30, respectively, being disposed within a host material 40 and dimensioned as the dielectric zigzag piece 20 depicted in FIG. 5.

Said first plurality of dielectric zigzag pieces 25 each having a plurality of upper notches 26 and a plurality of lower notches 27 and 28, respectively, having said width, w. Said second plurality of dielectric zigzag pieces 30 each having a plurality of upper notches 31 and a plurality of lower notches 32 and 33, respectively, having said width, w. Said first and second plurality of dielectric zigzag pieces 25 and 30, respectively, being constructed to orthogonally interconnect with one another so that said width, w, of the upper notch 26 of said first plurality of dielectric zigzag pieces 25 fits together with one of the lower notches 33, having the same width, w, of said second plurality of dielectric pieces 30 and so on, so that when all of said notches are orthogonally interconnected a diamond-patterned lattice 35 is provided. Said diamond-patterned lattice 35 providing a sub-crystal, each of said sub-crystals comprising a minimum of 18 of said dielectric zigzag pieces 25 and 30, respectively, and three (3) repeating units.

Said sub-crystal, having the diamond-patterned lattice 35, when stacked in parallel on top of at least one other sub-crystal having a similar diamond-patterned lattice constructed from a third and fourth plurality of dielectric zigzag pieces, comprises a crystal structure exhibiting a common wideband forbidden bad gap with respect to both polarizations. Each of said third and fourth plurality of dielectric zigzag pieces having a plurality of upper notches, a plurality of lower notches and a set of identical dimensions differing from those of said first and second plurality of dielectric zigzag pieces. If $\Delta$ is the fractional band gap size for a single infinite sub-crystal, then if the linear dimensions of a plurality of such successive sub-crystals are decreased by a factor of:

$$\frac{(2-\Delta)}{(2+\Delta)}$$

then the effective fractional band gap size for a stack of N sub-crystals approximates:

$$\frac{2[(2+\Delta)^N-(2-\Delta)^N]}{[(2+\Delta)^N+(2-\Delta)^N]}$$

In the preferred embodiment of the present invention, said diamond-patterned lattice 35 may comprise as many as 18 diamond-shaped spaces with at least three (3) repeating units for said sub-crystal structure to exhibit photonic properties.

In this embodiment of the present invention, said host material 40 may be made of any dielectric material, such as alumina, as listed on Table I, while said first and second pluralities of dielectric zigzag pieces 25 and 30, respectively, can be made of titania or MCT-140, also from Table I. Fabricating the structure with a dielectric material such as alumina along with using either titania or MCT-140 as said host material 40 provides the additional benefit of increasing the effective permittivity of the photonic crystal. It is noted that either the ferromagnetic or high $\mu$ materials may also be advantageously used.

While FIG. 7 depicts only a single sub-crystal structure, the preferred embodiment of the present invention contemplates stacking a plurality of said sub-crystals to form a crystal structure, each of said sub-crystals having a diamond-patterned lattice such as the diamond-patterned lattice 35 depicted in FIG. 7 in parallel with each other to construct a three-dimensional photonic band gap crystal which achieves the desired band gap properties of the preferred embodiment. The variations and uses described in connection with the first embodiment, apply equally to the preferred embodiment, including coupling said crystal structure 40 to an antenna such as a spiral antenna with equiangular arms, such as those depicted in FIGS. 3 and 10, respectively, in proximity to said crystal structure 40, and a signal generating means in order to provide a monolithic ultra wideband antenna.

The third embodiment of the present invention encompasses a two-dimensional Frequency, Time, Spatial and Polarization ("FTSP") parameter tunable photonic band gap crystal composed of dielectric, ferroelectric pieces that provides an ultra-wideband band gap exhibiting a bandwidth greater than an octave, compactness and the ability to simultaneously select frequency, time, spatial and polarization parameters.

The third embodiment is a tuneable variation of the first embodiment having a similar configuration of at least two sub-crystal structures, each having a lattice disposed within a host material, with a first sub-crystal having a plurality of rods of the same dimension arranged in parallel rows and columns, with the rods having predetermined dimensions and the rows and columns being spaced from each other in a predetermined manner and a rod axis, and a second sub-crystal having a second plurality of differently dimensioned rods, all of the second plurality of rods being of the same dimension, arranged in a plurality of parallel rows and columns, with the rows and columns of the second sub-crystal being spaced from each other in a predetermined manner having the same rod axis as said first sub-crystal, so that both sub-crystals, or multiple ones if using more than two, comprise a crystal structure. However, in the third embodiment, the rods are made of dielectric, ferroelectric material and have a thin layer of conducting material on two sides of each of the rods in order to provide a two-dimensional, tunable Frequency, Time, Space and Polarization ("FTSP") parameter selective photonic band gap crystal. In the third embodiment, using ferroelectric materials with a high refractive index allows one to obtain a high contrast ratio, leave a deep band gap and also reduce crystal dimensions. Additionally, the stacking of the crystal structures provides an ultra-wide band gap with respect to an electric field parallel to the rods, propagating normal to said rod axis.

Referring back to FIG. 3 showing the configuration of the first embodiment, a plurality of rods 5 in a fourth row of rods 6 are coated with a thin layer of conductive material 7 providing at least two metalized surfaces, and a pair of tabs 8 and 9, respectively, which are attached to each of said plurality of rods 5, after the thin layer of conductive material 7, in order to form an electrical connection with a voltage biasing means to generate a voltage gradient across said metalized surfaces. For ease of illustration, FIG. 3 only points out said thin layer of conductive material 7 on one of said plurality of rods 5 in the fourth row 6 and likewise said tabs 8 and 9, respectively, on a few of them, while the third embodiment requires configuring all of said plurality of rods that way. Further, said plurality of rods need to be coated and tabbed prior to being disposed in said host material 11.

Due to the intrinsic nature of the ferroelectric material used in said plurality of rods 5, their dielectric constants are varied a predetermined amount as a function of the voltage change, and, in turn, the dispersion characteristics of the band gap are changed. For low voltage (tens of voltages), the separation between said two metalized surfaces should be as small as feasible such as a thin, flat rectangular cross sectional rod where w>h. Also, the metalized coating thickness should be much less than the operating wavelength in order to avoid adverse skin depth effects and unwanted internal reflections so that the integrity of the photonic band gap crystal is maintained.

In operation, other sub-crystals, each having a plurality of dielectric, ferroelectric rods with different predetermined cross sections, widths and inter-rod spacings, are vertically stacked behind said sub-crystal. For example, where four such sub-crystals having equally spaced, identical rods are stacked back-to-back, the width dimensions of the ferroelectric, rectangular rods for each of said plurality of sub-crystals are: $w_1$=0.062a, $w_2$=0.089a, $w_3$=0.062b, and $w_4$=0.089b. The a and b terms are the inter-rod spacings and said ferroelectric rods have a square cross-section so, w=h. Furthermore, while said plurality of rods of the first embodiment can be square, rectangular, circular or elliptical in shape, said plurality of rods in the third embodiment can only be square or rectangular.

Figure 8:
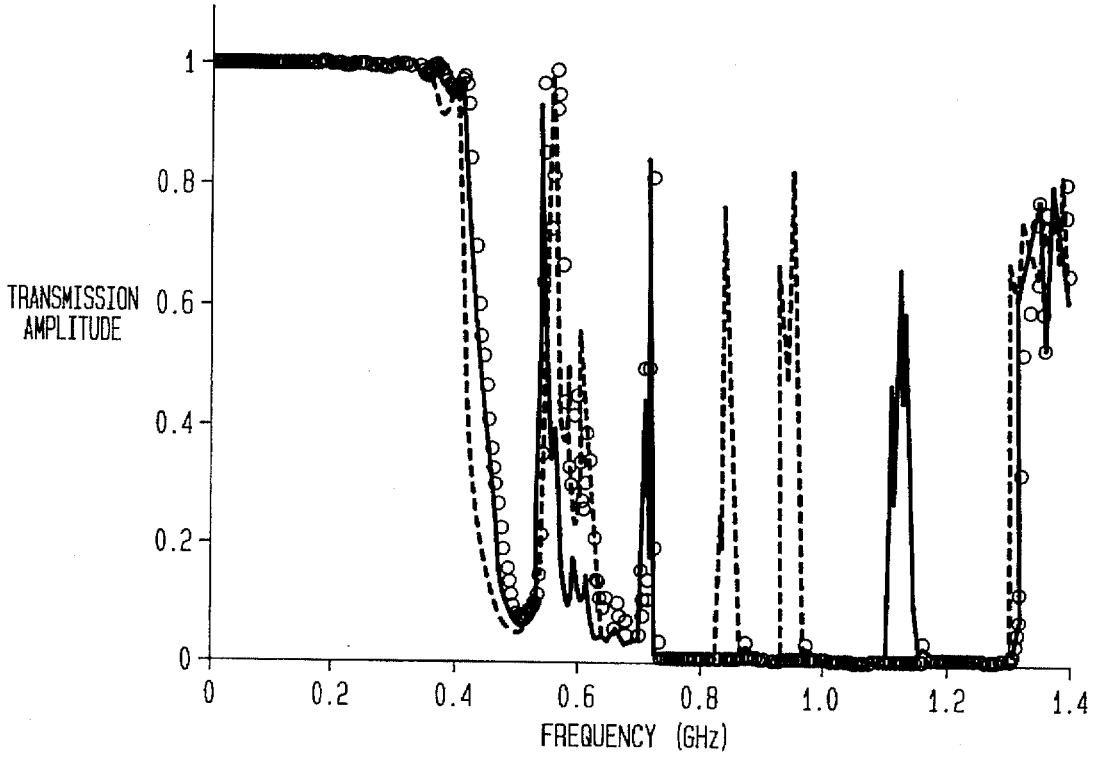
FIG. 8 is a computer generated plot of the transmitted amplitude versus frequency for a TE polarized wave incident normal upon the FIG. 8 two-dimensional photonic band gap crystal where $\epsilon_r$ is varied.

FIG. 8 displays the computer generated transmission amplitude spectra versus frequency for a TE polarized wave incident normal upon photonic band gap crystal of the third embodiment, based on four of said sub-crystals being stacked back-to-back and said dielectric, ferroelectric rods having the dimensions and inter-rod spacing relationships as given above to produce a band gap greater than an octave forbidding electromagnetic radiation to propagate perpendicular to the rod axis over the specifically designed frequency band gap, or stopband.

The spacings and dimensions can be scaled for various $\epsilon_r$ values and may also vary with the number and combination of dielectric, ferroelectric rods composing said sub-crystal. Depicting said crystal 15 in FIG. 3 with six rods in six rows is a preferable construction, however, other numbers of rods and rows may also be advantageously employed in the third embodiment. A photonic band gap crystal with four sub-crystals with dimensions of: $w_1$=0.062a, $w_2$=0.089a, $w_3$=0.062b, and $w_4$=0.089b provides an ultra wideband band gap from about 0.73 GHz to 1.3 GHz for the ferroelectric rod dielectric constant, $\epsilon_r$=22 and host material air. The band gap is scaled to other frequency bands by changing the dielectric constants of said plurality of ferroelectric, dielectric rods 5 and host material 11, as well as rod and inter-rod spacing dimensions.

Table I lists candidate dielectric materials, along with their dielectric constants and loss-tangents for use as said dielectric host material 11, while Table II gives the electronic properties of candidate ferroelectric materials for the N sets of said plurality of rods 5 in this embodiment. Table II indicates that ferroelectric materials are available with dielectric constants above 1000 and with relatively low loss-tangents. An excellent candidate material is BSTO-Oxide III with 20% oxide weight since the dielectric constant of 1079.21 is high, the loss-tangent of 0.0008 is low, and the tunability is 16%. The last column of Table II gives the electric field required to tune the dielectric constant.

The height, h, of said plurality of ferroelectric, dielectric rods 5 determines the bias voltage required for tuning a particular one of said plurality of ferroelectric rods. For very low-voltage operation, metalized, thin (w>>h), rectangular cross sectional rods can be utilized and a given number of these rods stacked on top of each other to form a composite, ferroelectric rod. The metalized coating thickness, t, should be transparent to the RF signal wavelength ($\lambda$>>t) so the integrity of the photonic band gap crystal is maintained, but still thick enough to behave like a good conductor. Since there is no current flow through said plurality of ferroelectric, dielectric rods 5, thick conductor coatings are not required to handle large currents.

In the third embodiment, said thin conductive layer 7 may be aluminum or copper. Said voltage biasing means used to supply the bias voltages to said plurality of ferroelectric, dielectric rods 5, may be accomplished by conventional means with voltage dividers used to generate the predetermined voltages to the rods to produce the desired tunability. A microprocessor control system may also be utilized to program or time the tuning mechanism. Said plurality of ferroelectric, dielectric rods 5 may also be metalized with a conductor material and said tabs 8 and 9, respectively, may be affixed at one end of N sets of said plurality of ferroelectric, dielectric rods 5. One can then arrange said plurality of rods in the desired configuration by supporting a lattice in a fixture. Said host material 11 can be added to surround said plurality of ferroelectric, dielectric rods 5 and fill up the inter-rod spacings by means well-known in the ceramic or plastic fields.

Referring once again to FIG. 8, the transmission/receive band centered around 1.17 GHz is obtained by tuning said plurality of ferroelectric, dielectric rods 5 of said sub-crystal to change the dielectric constant, $\epsilon_2$, from 22 to 26 (an 18% change). Other than the transmission/receive band centered around 1.17 GHz, a stopband still exists from 0.73 GHz to 1.3 GHz.

In operation, transmission/receive bands centered at different frequencies within the original forbidden band gap occur when the voltages are applied at different locations within said composite crystal. The transmission/receive bands centered around 0.95 GHz and 0.85 GHz occur when $\epsilon_3$ or $\epsilon_4$ is increased from 22 to 26. Therefore, frequency selectivity is demonstrated by changing the bias voltages and $\epsilon_r$ tuning of said plurality of ferroelectric, dielectric rods 5. Time selectivity is demonstrated by removing the bias voltages giving an UWB stopband filter. Placing the FTSP selective photonic band gap crystal of the third embodiment in front of an antenna, essentially makes a filter which behaves as an octave band shutter. Continuous frequency selectivity across the entire stopband is achievable by utilizing ferroelectric materials with large tunability or different ferroelectric materials for each of said sub-crystals that have overlapping tunable ranges.

For example, a sub-crystal 1 may have $\epsilon_r$=22 with the bias voltage off and $\epsilon_r$=26 with the bias voltage on. A sub-crystal 2 may have $\epsilon_r$=18 with the bias voltage off and $\epsilon_r$=22 with the bias voltage on. Operation with the bias voltage off for said sub-crystal 1 and the bias voltage on for said sub-crystal 2 gives $\epsilon_r$=22 for both sub-crystals and hence an overlapping stopband. However, when the bias voltage for said sub-crystal 1 is turned on and simultaneously it is turned off for said sub-crystal 2, then a 36% change occurs for $\epsilon_r$ ($\epsilon_r$=26 and $\epsilon_r$=18 for said sub-crystal 1 and said sub-crystal 2, respectively). This technique would double the tunability range without compromising another material parameter such as the electric field required for tuning $\epsilon_r$ or loss-tangent. Also, the ferroelectric materials can be custom made by changing the weight percent of the oxide.

In the third embodiment, spatial selectivity is obtained due to the crystal's forbidden band gap which will not allow RF energy, with frequency content in the bandwidth of the forbidden band gap, to penetrate said crystal thus eliminating side-lobes. Polarization selectivity is obtained by using 2- or 3-dimensional photonic band gap crystals. It is clear that multiple FTSP selectivity is simultaneously obtained for a fixed crystal design.

Consequently, to those skilled in the art, different system objectives, filter or antenna for example, may require different design and material parameters and compromises in material characteristics for the FTSP selective photonic band gap crystal. Some examples are: High contrast [$\sqrt{(\epsilon_r\text{ (rods)}/\epsilon_r\text{(host material))}}$]between said host material 11 and N sets of ferroelectric, dielectric rods 5 is one objective. Another objective is to use dielectric materials with low loss-tangents, $\epsilon''$, see Table I, since the photonic crystal is a filter. A high loss-tangent $\epsilon''$ for the photonic crystal would affect the ability of the photonic crystal to reflect the electromagnetic energy and transmit the desired signal without attenuation. Note from Table I that in general as $\epsilon'(\epsilon_r)$ increases, $\epsilon''$ also increases.

Other important considerations of choice for dielectric materials are power handling, frequency of operation, and compactness. As the frequency is increased, the photonic crystal size decreases, therefore, for operation at high microwave frequencies, above X-band, one may choose to obtain the high contrast between dielectric materials of moderate $\epsilon_r$ values so that the effective refractive index of the crystal is small and hence the physical size of the crystal is large. For example, $\epsilon_r$=12 for the rods and $\epsilon_r$=1 for the host material. However, when the frequency of operation is low, below S-band, one may choose to obtain the high contrast between dielectric materials of large, $\epsilon_r$, values so that the effective refractive index is large and hence the physical size of the crystal is small. As an example, $\epsilon_r$=1000 for the rods and $\epsilon_r$=100 for said host material 11. Power, frequency, and size trade-offs for various dielectric material properties and geometries are necessary to obtain particular filter and antenna design objectives.

In connection with the third and fourth embodiments, while prior art techniques are available for achieving FTSP selectivity these techniques do not achieve simultaneous FTSP in a fixed design. Further, in connection with the third embodiment, prior art techniques such as frequency selective techniques may be used to reduce the antenna effective area for frequencies outside the operating passband. Examples are the use of narrow-band antenna structures and metal radomes with a resonant aperture array on the surface. Polarization selectivity can be accomplished by designing the antenna structure to respond only to waves with a prescribed polarity. For example, linear polarization is achieved by proper design of the feed structure for horn or reflector antennas. Also, polarization selectivity may incorporate metal strips in a radome, or strips and lattice structures into the antenna design. Time selectivity techniques utilize electrical and mechanical shutters to exclude both in-band and out-of-band energy when the antenna is not in use. Spatial selective techniques aim at reducing a directional antenna's cross-section over certain regions of space. For example, side lobes are controlled by a lossy shield, a tunnel, a dielectric-layer filter and metallic grids. The crystal of the third embodiment of the present invention can be designed as a filter to have simultaneous multi-functional selectivity, or tunability, and it can be placed either in front of, or behind, a transmit or receive antenna or in a waveguide to accomplish these functions.

The third embodiment can also be utilized as a substrate for monolithic antennas because the structure of the photonic band gap crystal prevents the low-coupling efficiency to free space as well as the effects of internal radiation trapping and heat dissipation that has heretofore been a problem with monolithic antennas. The third embodiment allows the design of an antenna to have narrow or wide band responses which are selective by voltage tuning. In the third embodiment, low-cost devices can also be achieved by using conventional ceramic forming and metalizing processes.

The fourth embodiment of the present invention provides a three-dimensional FTSP tunable photonic band gap crystal with zigzag ferroelectric, dielectric pieces in a diamond-patterned lattice that provides an ultra-wideband band gap exhibiting a bandwidth greater than an octave, compactness and the ability to select parameters relating to frequency, time, spatial and polarization.

The fourth embodiment is a tuneable variation of the preferred embodiment having a similar configuration of at least two sub-crystals, with each sub-crystal having a diamond-patterned lattice having a plurality of zigzag pieces orthogonally interconnected, disposed within a host material, forming a sub-crystal. A crystal structure, having a plurality of such sub-crystal structures stacked with each sub-crystal composed of zigzag pieces of predetermined dimensions which are different for each sub-crystal, provides a wideband photonic band gap crystal exhibiting a common forbidden gap with respect to both polarizations. However, in the fourth embodiment, the zigzag pieces are dielectric, ferroelectric, and, similar to the third embodiment, the ferroelectric pieces are thinly coated on at least two sides with conducting material to provide an ultra-wideband (UWB) band gap having the ability to select parameters relating to frequency, time, spatial and polarization.

The fourth embodiment provides a common forbidden band gap for both the parallel (TE) and perpendicular (TM) polarizations. The desired ultra-wideband is achieved by stacking two or more layers of photonic sub-crystals with different zigzag piece cross sectional dimensions and inter-zigzag spacings to create parallel lattices. Additionally, both the third and fourth embodiments provide tuneable crystals for RF filters and antenna substrates.

Figure 9:
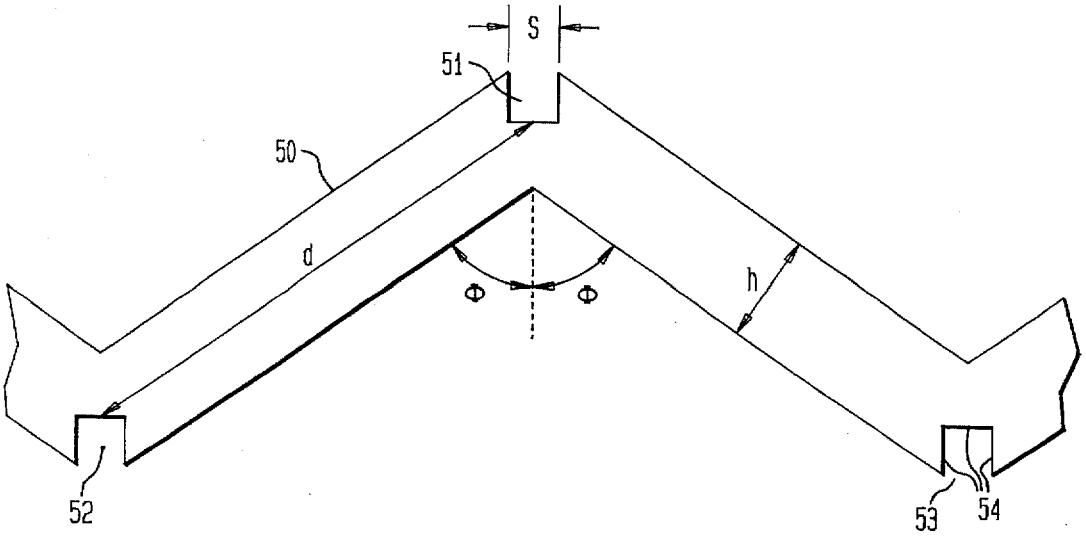
FIG. 9 depicts a front view of a single zigzag ferroelectric piece of the fourth embodiment. This zigzag piece is stacked and arranged with additional pieces to form the diamond configuration of the three-dimensional photonic band gap crystal.

Referring now back to FIG. 7, a perspective view of the preferred embodiment is provided depicting a first plurality of dielectric zigzag pieces 25 shown orthogonally interconnecting with a second plurality of dielectric zigzag pieces 30, which, for ease of illustration, are darkened. Both said first and second plurality of dielectric pieces 25 and 30, respectively, being disposed within a host material 40 and dimensioned as a dielectric, ferroelectric zigzag piece 50 depicted in FIG. 9, except that in this fourth embodiment, the zigzag pieces are dielectric, ferroelectric. Referring now to FIG. 9, said single dielectric, ferroelectric zigzag piece 50 utilized in the fourth embodiment is depicted, having a plurality of upper notches 51 and a plurality of lower notches 52 and 53, respectively, with each of the notches having an insulating coating 54 on its interior surfaces shown in connection with said lower notch 53 in order to isolate the zigzag pieces. A center frequency, $f_o$, of a sub-crystal is:

$$f=\frac{0.6c}{a}$$

where c is the speed of light, a is the inter-zigzag piece spacings of the lattice, and air is the host material. The distance, d , of said dielectric, ferroelectric zigzag piece 50 is:

$$d=\sqrt{3}\left(\frac{a}{4}\right)$$

The angle Φ is:

$$\cos^{-1}\left(\frac{1}{\sqrt{3}}\right)$$

The ratio, R, of the width, s, of an one of said upper notch 51 to the height, h, of said dielectric, ferroelectric zigzag piece 50 is R≅0.66. As an example, for a ferroelectric, rectangular cross sectional, zigzag piece with a refractive index between 3 and 4, then Φ≅54.7°, h≅0.24a, s≅0.16a, a=0.6 $\lambda_o$, which is the free space wavelength, and d≅0.26 $\lambda_o$. Note, for a host material different from air, the wavelength would change to that of the new host material.

In the FTSP selective three-dimensional photonic band gap crystal of the fourth embodiment, the effective band gap size for a stack of N sub-crystals is approximately:

$$\frac{2[(2+\Delta)^N-(2-\Delta)^N]}{[(2+\Delta)^N+(2-\Delta)^N]}$$

where Δ is the fractional band gap size for a single infinite sub-crystal and the linear dimensions of successive sub-crystals are decreased by a factor of:

$$\frac{(2-\Delta)}{(2+\Delta)}$$

Similar to the third embodiment, a plurality of said dielectric, ferroelectric zigzag pieces are coated with a thin layer of conducting material on two surfaces, and a pair of metal tabs, similar to those depicted in FIG. 7 in connection with the third embodiment, are added to the zigzag pieces after coating, to make the electrical connections to a voltage biasing means. On the three surfaces of said lower notch 53 depicted in FIG. 9, said insulator material 54 is deposited with an $\epsilon_r$ similar or equal to the selected host material.

The principle of operation of this fourth embodiment is essentially the same as the third embodiment:the dispersion characteristics of the sub-crystals are changed by changing the bias voltages and hence the dispersion characteristics of the entire crystal. This device has a common forbidden band gap with respect to both parallel (TE) and perpendicular (TM) polarizations. A plurality of sub-crystals, each having the plurality of dielectric, ferroelectric zigzag pieces 50 orthogonally interconnected to form the diamond-patterned lattice similar to the preferred embodiment, are stacked back-to-back to give an ultra-wideband band gap.

Polarization selectivity can be obtained by applying different bias voltages to said metal tabs utilizing said voltage biasing means. Since said plurality of dielectric, ferroelectric zigzag pieces 50 provide two orthogonal lattice sets, different bias voltages to the two lattice sets transform the three-dimensional photonic band gap crystal into a two-dimensional photonic band gap crystal, thereby generating a common forbidden band gap with respect to only the parallel (TE) polarization. For example, if said plurality of dielectric, ferroelectric zigzag pieces 50 of the diamond-patterned lattice has the same dielectric constant as the selected host material when the bias voltage is off, then a three-dimensional photonic band gap crystal will occur when a bias voltage is applied to said plurality of dielectric, ferroelectric zigzag pieces 50 of both orthogonal lattices of the sub-crystals, and a two-dimensional photonic band gap occurs when a bias voltage is applied to only one of the orthogonal lattices of any of the other sub-crystals.

Said plurality of dielectric, ferroelectric zigzag pieces 50 may be cut from a large sheet of ferroelectric material in an arrangement similar to FIG. 6. Each of said plurality of dielectric, ferroelectric zigzag pieces 50 has three repeating units, and a minimum of 18 pieces are needed to make a single sub-crystal. Said plurality of dielectric, ferroelectric zigzag pieces 50, after being metalized, are assembled into said diamond-patterned lattice by connecting said plurality of notches, 51, 52 and 53, respectively, to notches of another zigzag piece at a 90° orientation to form orthogonal lattices. The selected host material is added to surround said plurality of dielectric, ferroelectric zigzag pieces 50 to fill up the inter-rod spacings by means well-known in the ceramic and plastic fields. Further, in both the third and fourth embodiments, low-cost devices can be achieved by using conventional ceramic forming and metalizing processes.

The present invention also encompasses a number of methods for achieving photonic band gaps with two and three dimensional photonic band gap crystals.

The method for making a two-dimensional ultra wideband photonic bandwidth crystal comprises the steps of arranging a first plurality of dielectric rods of the same dimension in parallel rows and columns, with the rods having predetermined dimensions and the rows and columns being spaced from each other in a predetermined manner having a rod axis, forming a first lattice from said plurality of arranged dielectric rods and disposing said first lattice within a host material to form a first sub-crystal. Next, arranging a second plurality of differently dimensioned dielectric rods, in a plurality of parallel rows and columns, with the rows and columns being spaced from each other in a predetermined manner having said rod axis, all of the second plurality of dielectric rods being of the same dimension, forming a second lattice from said second plurality of dielectric rods and disposing said second lattice within said host material to form a second sub-crystal. Aligning in parallel said first and second sub-crystals to form a crystal structure where the stacking of said first and second sub-crystals of the crystal structure provides a wideband photonic band gap for TE waves, an electric field perpendicular to the rods, propagating normal to said rod axis, which also achieves a smaller band gap for TM waves.

Disposing said pluralities of dielectric rods within said host material in this manner allows said first sub-crystal to produce a stopband with more than a 20% bandwidth. Stacking of said first sub-crystal and said second sub-crystal, respectively, in parallel allows a crystal to have an octave band gap. Stacking said sub-crystals results in the larger bandwidth structure providing a photonic band gap crystal. In this method of the present invention said plurality of dielectric rods may be shaped to have square, rectangular, circular or elliptical cross-sections. Using dielectric/ferroelectric materials with a high refractive index reduces crystal dimensions while a high contrast between the dielectric material and other host material increases the depth of the band gap. Said crystal structure may be coupled with an antenna such as a spiral antenna with equiangular arms and a signal generating means in order to provide a monolithic ultra wideband antenna. It is necessary for said signal generating means to be an ultra wideband generator for the circuit to achieve an ultra wideband response.

The present invention also includes a method of making a three-dimensional photonic band gap crystal comprising the steps of forming a first and second plurality of dielectric zigzag pieces, each of said dielectric zigzag pieces having a plurality of upper notches, a plurality of lower notches and the same dimensions. Said first and second plurality of dielectric zigzag pieces each having at least eighteen pieces and a minimum of three repeating units. Orthogonally interconnecting said first and second plurality of dielectric zigzag pieces to form a diamond-patterned first sub-crystal and disposing said first sub-crystal within a host material. The next steps are forming a second diamond-patterned sub-crystal from a third and fourth plurality of dielectric zigzag pieces, said third and fourth plurality of dielectric zigzag pieces being differently dimensioned than those of said first sub-crystal and orthogonally interconnecting said third and fourth plurality of dielectric pieces to form a diamond-patterned second sub-crystal. Stacking said first and second sub-crystal structures, or more, in parallel results in a crystal structure providing a wideband photonic band gap crystal exhibiting a common forbidden gap with respect to both polarizations.

The present invention also discloses a method of achieving a photonic band gap with a two-dimensional, tunable Frequency, Time, Space and Polarization ("FTSP") parameter selective photonic band gap crystal which is a variation of the first method of the present invention, however in this method, ferroelecrtric, dielectric rectangular rods are aligned and coated on two sides with a thin layer of conducting material. This method comprises the steps of arranging a first plurality of ferroelecrtric, dielectric rods of the same dimension in parallel rows and columns, with the rods having predetermined dimensions and the rows and columns being spaced from each other in a predetermined manner along a rod axis, forming a first lattice from said first plurality of arranged dielectric rods, coating said ferroelectric, dielectric rods of the first lattice with a thin layer of conductive material on at least two sides and disposing said first lattice within a host material to form a first sub-crystal. Also, instead of inserting said first and second pluralities of dielectric rods into cylinders, one skilled in the art could insert a mass of dielectric powder into the hollowed-out areas and, using centrifugal force, compact the dielectric powder into a group of high-density rods having either square, rectangular, circular or elliptical cross-sections. Furthermore, while said plurality of rods of the first embodiment can be shaped to have a square, rectangular, circular or elliptical cross-section, said plurality of rods in the third embodiment can only be shaped with a square or rectangular cross-section.

That step is followed by arranging a second plurality of differently dimensioned ferroelectric, dielectric rods, in a plurality of parallel rows and columns, spacing the rows and columns from each other in a predetermined manner having said rod axis, all of the second plurality of dielectric rods being of the same dimension which differ from those of said first plurality of ferroelectric, dielectric rods, forming a second lattice from said second plurality of dielectric rods, coating the ferroelectric, dielectric rods of the second lattices with said thin layer of conductive material on at least two sides and disposing said second lattice within said host material to form a second sub-crystal. Forming a plurality of tabs on a plurality of said ferroelectric, dielectric rods of the first and second lattices. Aligning in parallel said first and second sub-crystal structures to form a crystal structure and stacking said first and second sub-crystals of the crystal structure provides a wideband photonic band gap. Coupling said tabs to a voltage biasing means allows simultaneous selection of Frequency, Time, Space and Polarization ("FTSP") parameters of said photonic band gap crystal.

The final method disclosed by the present invention is a method of making a three-dimensional FTSP selective photonic band gap crystal which is a variation of the second method of the present invention utilizing at least two diamond-patterned lattices, however in this method, ferroelecrtric, dielectric zigzag pieces are aligned and coated on at least two sides with a thin layer of conducting material to provide a biasing voltage needed to change the dielectric constant of the zigzag pieces allowing simultaneous parameter selection similar to the third embodiment and a plurality of notches are coated with an insulating material.

The final method for achieving photonic band gap crystal with a three-dimensional FTSP selective photonic band gap crystal comprises the steps of forming a first and second plurality of ferroelectric, dielectric zigzag pieces, said ferroelectric, dielectric zigzag pieces having a plurality of upper notches, a plurality of lower notches and the same dimensions. Said first and second plurality of ferroelectric, dielectric zigzag pieces each having a minimum of eighteen pieces and a minimum of three repeating units. Coating said ferroelectric, dielectric rods of the first lattice with a thin layer of conductive material on at least two sides and applying an insulating material on the interior surfaces of said plurality of upper notches and said plurality of lower notches. Orthogonally interconnecting said first and second plurality of ferroelectric, dielectric zigzag pieces to form a first diamond-patterned lattice and disposing said first diamond-patterned lattice within a host material to form a first sub-crystal.

The next step is forming a second diamond-patterned sub-crystal from a third and fourth plurality of ferroelectric, dielectric zigzag pieces, said third and fourth plurality of ferroelectric, dielectric zigzag pieces being differently dimensioned those of said first sub-crystal structure, said ferroelectric, dielectric zigzag pieces having a plurality of upper notches, a plurality of lower notches and the same dimensions. Said third and fourth plurality of ferroelectric, dielectric zigzag pieces each having a minimum of eighteen pieces and at least three (3) repeating units. Coating said third and fourth plurality of ferroelectric, dielectric rods with said thin layer of conductive material on at least two sides and applying said insulating material around the interior surface of said plurality of upper and lower notches. Forming a plurality of tabs on a plurality of said ferroelectric, dielectric pieces of the first and second lattices. Orthogonally interconnecting said third and fourth plurality of ferroelectric, dielectric pieces to form a second diamond-patterned lattice and disposing said second diamond-patterned lattice within said host material to form a second sub-crystal. Aligning in parallel said first and second sub-crystals to form a crystal structure. The stacking of said first and second sub-crystals of the crystal structure provides a wideband photonic band gap. Coupling said tabs to a voltage biasing means allows simultaneous selection of Frequency, Time, Space and Polarization ("FTSP") parameters of said photonic band gap crystal in manner similar to the third embodiment.

We wish it to be understood that although various embodiments of the present invention are disclosed and described herein for the purposes of illustration, they are not meant to be limiting. Those of skill in the art may recognize alterations and modifications that can be made in the illustrated embodiments. Such alterations and modifications are meant to be covered by the spirit and scope of the appended claims.

TABLE II

Sample Ferroelectric Materials Suitable For Constructing Photonic Crystals

Electronic Properties of BSTO (Ba = .6) and Alumina Ceramic Composites.

| Alumina Content (wt %) | Dielectric Constant | Loss Tangent | % Tunability | Electric Field (V/μm) |
|---|---|---|---|---|
| 0.0 | 3299.08 | 0.0195 | 19.91 | 0.73 |
| 1.0 | 2606.97 | 0.0122 | 22.50 | 0.76 |
| 5.0 | 1260.53 | 0.0630* | 13.83 | 0.67 |
| 10.0 | 426.74 | 0.0163 | 4.79 | 0.39 |
| 15.0 | 269.25 | 0.0145 | 3.72 | 0.87 |
| 20.0 | 186.01 | 0.0181 | 3.58 | 0.48 |
| 25.0 | 83.07 | 0.0130 | | |
| 30.0 | 53.43 | 0.0135 | 5.13 | 2.31 |
| 35.0 | 27.74 | 0.0029 | 0.51 | 0.83 |
| 40.0 | 25.62 | 0.1616* | | |
| 60.0 | 16.58 | 0.0009 | 0.01 | 0.60 |
| 80.0 | 12.70 | 0.0016 | | |
| 100.0 | 8.37 | 0.0036 | | |

Electronic Properties of BSTO-Oxide II Ceramic Composites

| Oxide II Content (wt %) | Dielectric Constant | Loss Tangent | % Tunability | Electric Field (V/μm) |
|---|---|---|---|---|
| 0.0 | 3299.08 | 0.0195 | 19.91 | 0.73 |
| 1.0 | 2696.77 | 0.0042 | 46.01 | 3.72 |
| 5.0 | 2047.00 | 0.0138 | 12.70 | 0.76 |
| 10.0 | 1166.93 | 0.0111 | 7.68 | 0.68 |
| 15.0 | 413.05 | 0.0159 | 5.07 | 1.11 |
| 20.0 | 399.39 | 0.0132 | 5.39 | 0.76 |
| 25.0 | 273.96 | 0.0240 | 6.02 | 1.02 |
| 30.0 | 233.47 | 0.0098 | 1.31 | 0.73 |
| 35.0 | 183.33 | 0.0091 | 3.87 | 0.93 |
| 40.0 | 163.26 | 0.0095 | 0.70 | 0.71 |
| 50.0 | 92.73 | 0.0071 | 1.69 | 1.12 |
| 60.0 | 69.80 | 0.0096 | | |
| 80.0 | 17.31 | 0.0056 | | |
| 100.0 | 15.98 | 0.0018 | 0.08 | 0.27 |

Electronic Properties of BSTO-Oxide III Ceramic Composites.

| Oxide III Content (wt %) | Dielectric Constant | Loss Tangent | % Tunability | Electric Field (V/μm) |
|---|---|---|---|---|
| 0.0 | 3299.08 | 0.0195 | 19.91 | 0.73 |
| 1.0 | 1276.21 | 0.0015 | 16.07 | 2.32 |
| 5.0 | 1770.42 | 0.0014 | | |
| 10.0 | 1509.19 | 0.0018 | | |
| 15.0 | 1146.79 | 0.0011 | 7.270 | 1.91 |
| 20.0 | 1079.21 | 0.0009 | 15.95 | 2.23 |
| 25.0 | 783.17 | 0.0007 | 17.46 | 2.45 |
| 30.0 | 750.93 | 0.0008 | 9.353 | 1.62 |
| 35.0 | 532.49 | 0.0006 | 18.00 | 2.07 |
| 40.0 | 416.40 | 0.0009 | 19.81 | 2.53 |
| 50.0 | 280.75 | 0.117* | 9.550 | 2.14 |
| 60.0 | 117.67 | 0.0006 | 11.08 | 2.70 |
| 80.0 | 17.00 | 0.0008 | 0.61 | 1.72 |
| 100.0 | 13.96 | 0.0009 | | |

*samples had poor contacts

TABLE I

Sample of Dielectric Materials (Sold by Trans Tech)

| Composition and type number | Dielectric constant (e') | Dielectric loss tangent (e"/e') |
|---|---|---|
| Basic Dielectrics | | |
| D-4 Cordierite | 4.5 ± 0.2 @ 9.4 GHz | ≦0.0002 |
| D 8-6 Fosterite | 8.3 ± 0.3 @ 9.4 GHz | ≦0.0002 |
| DA-9 Alumina* | 8.5 ± 0.3 @ 9.4 GHz | ≦0.0001 |
| D-13 Mg-TI* | 13.0 ± 0.5 @ 9.4 GHz | ≦0.0002 |
| D-15 Mg-TI | 15.0 ± 0.5 @ 9.4 GHz | ≦0.0002 |
| D-16 Mg-TI | 16.0 ± 0.5 @ 9.4 GHz | ≦0.0002 |
| D-35 Ba-TI | 37.0 ± 5% @ 6 GHz | ≦0.0005 |
| D-50 Ba-TI | 50.0 ± 5% @ 6 GHz | ≦0.0005 |
| D-100 Titania | 100.0 ± 5% @ 6 GHz | ≦0.0010 |
| SMAT Series | | |
| SMAT-9 | 9 ± 0.3 @ 9.4 GHz | ≦.00015 |
| SMAT-9.5 | 9.5 ± 0.3 @ 9.4 GHz | ≦.00015 |
| SMAT-10 | 10 ± 0.3 @ 9.4 GHz | ≦.00015 |
| SMAT-11 | 11 ± 0.3 @ 9.4 GHz | ≦.00015 |
| SMAT-12 | 12 ± 0.3 @ 9.4 GHz | ≦.00015 |

*SMAT can be used in lieu of DA-9 & D-13 for ease of machining

What is claimed is:

1. A two-dimensional ultra wideband photonic band gap crystal comprising:

a first plurality of dielectric rods of the same dimension placed in parallel rows and columns spaced from each other in a predetermined manner and having a rod axis, to form a first lattice;

said first lattice being disposed within a host material to from a first sub-crystal;

a second plurality of dielectric rods placed in parallel rows and columns spaced from each other in a predetermined manner having said rod axis, said second plurality of dielectric rods all having an identical set of dimensions differing from said same dimensions of the first plurality of dielectric rods, to form a second lattice;

said second lattice being disposed within said host material to form a second sub-crystal, said first and said second sub-crystals being aligned in parallel to form a crystal structure; and said crystal structure having said first and second sub-crystals stacked to provide a wideband photonic band gap for TE waves, an electric field parallel to said first and second plurality of dielectric rods, propagating normal to said rod axis and a band gap for TM waves smaller than said wideband photonic band gap.

2. The two-dimensional ultra wideband photonic band gap crystal as recited in claim 1, further comprising:

each of said first plurality of dielectric rods having a first square cross-sectional dimension, W;

a first constant inter-rod spacing, d, between each of said first plurality of dielectric rods;

each of said second plurality of dielectric rods having a second constant square cross-sectional dimension, W/2; and a second constant inter-rod spacing, d/2, between each of said second plurality of dielectric rods.

3. The two-dimensional ultra wideband photonic band gap crystal as recited in claim 2, further comprising:

a plurality of other sub-crystals formed in a manner similar to said first and second sub-crystals;

said crystal structure having said first, second and plurality of other sub-crystals stacked; and said crystal structure having an octave band gap.

4. The two-dimensional ultra wideband photonic band gap crystal as recited in claim 3, further comprising said first and second plurality of dielectric rods having a rectangular cross-section.

5. The two-dimensional ultra wideband photonic band gap crystal as recited in claim 3, further comprising connecting said crystal structure to an antenna circuit and a signal generating means to provide a monolithic ultra wideband antenna.

6. The two-dimensional ultra wideband photonic band gap crystal as recited in claim 5, wherein said signal generating means is an ultra wideband generator achieving an ultra wideband response.

7. The two-dimensional ultra wideband photonic band gap crystal as recited in claim 5, wherein said antenna is a spiral antenna with a plurality of equiangular arms.

8. The two-dimensional ultra wideband photonic band gap crystal as recited in claim 3, further comprising said first and said second plurality of dielectric rods having a circular cross-section.

9. The two-dimensional ultra wideband photonic band gap crystal as recited in claim 3, further comprising said first and said second plurality of dielectric rods having an elliptical cross-section.

10. The two-dimensional ultra wideband photonic band gap crystal as recited in claim 3, wherein said crystal structure is a filter.

11. A three-dimensional ultra wideband photonic band gap crystal comprising:

a first plurality of dielectric zigzag pieces, having at least eighteen dielectric zigzag pieces with a minimum of three repeating units, each of said first plurality of dielectric zigzag pieces having a plurality of upper notches, a plurality of lower notches and the same dimensions;

a second plurality of dielectric zigzag pieces, having at least eighteen dielectric zigzag pieces with a minimum of three repeating units, each having a plurality of upper notches, a plurality of lower notches and said same dimensions;

said first and second plurality of dielectric zigzag pieces being orthogonally interconnected into a first lattice;

said first lattice, being diamond-patterned and disposed within a host material, forms a first sub-crystal structure;

a second lattice, being diamond-patterned and constructed from a third and fourth plurality of dielectric zigzag pieces, each having a plurality of upper notches, a plurality of lower notches and a set of identical dimensions differing from said same dimensions of the first and second plurality of dielectric zigzag pieces;

said third and fourth plurality of dielectric zigzag pieces, each having at least eighteen dielectric zigzag pieces with a minimum of three repeating units, being orthogonally interconnected into a second lattice;

said second lattice, being diamond-patterned and disposed within said host material, forms a second sub-crystal structure;

said first and said second sub-crystals being aligned in parallel to form a crystal structure; and said crystal structure having said first and second sub-crystals stacked to provide a wideband photonic band gap crystal exhibiting a common forbidden gap with respect to both TE and TM polarizations.

12. The three-dimensional ultra wideband photonic band gap crystal as recited in claim 11, further comprising:

a plurality of other sub-crystals formed in a manner similar to said first and second sub-crystals; and said crystal structure having said first, second and plurality of other sub-crystals stacked.

13. The three-dimensional ultra wideband photonic band gap crystal as recited in claim 12, further comprising connecting said crystal structure to an antenna circuit and a signal generating means to provide a monolithic ultra wideband antenna.

14. The three-dimensional ultra wideband photonic band gap crystal as recited in claim 13, wherein said signal generating means is an ultra wideband generator achieving an ultra wideband response.

15. The three-dimensional ultra wideband photonic band gap crystal as recited in claim 13, wherein said antenna is a spiral antenna with a plurality of equiangular arms.

16. The three-dimensional ultra wideband photonic band gap crystal as recited in claim 15, further comprising said first and second diamond-shaped lattices each having 36 dielectric zigzag pieces with three repeating units.

17. The three-dimensional ultra wideband photonic band gap crystal as recited in claim 12, wherein said crystal structure is a filter.

18. A two-dimensional FTSP selective ultra wideband photonic band gap crystal comprising:

a first plurality of ferroelectric, dielectric rods, being rectangularly shaped, having the same dimensions, a dielectric constant and a thin layer of conductive material on two sides;

a plurality of pairs of electrodes being attached to said sides of the first plurality of ferroelectric, dielectric rods having said thin layer of conductive material;

said first plurality of ferroelectric, dielectric rods being placed in parallel rows and columns spaced from each other in a predetermined manner having a rod axis, to form a first lattice;

said first lattice being disposed within a host material to form a first sub-crystal;

a second plurality of ferroelectric, dielectric rods, each being rectangularly shaped, having an identical set of dimensions, a dielectric constant and a thin layer of conductive material on two sides;

said plurality of pairs of electrodes being attached to said sides of the second plurality of ferroelectric, dielectric rods having said thin layer of conductive material;

said second plurality of ferroelectric, dielectric rods being placed in parallel rows and columns spaced from each other in a predetermined manner having said rod axis, said identical set of dimensions differing from said same dimensions of the first plurality of ferroelectric, dielectric rods, to form a second lattice;

said plurality of pairs of electrodes being attached to said sides of the second plurality of ferroelectric, dielectric rods having said thin layer of conductive material;

said second lattice being disposed within said host material to form a second sub-crystal;

said first and said second sub-crystals being aligned in parallel to form a crystal structure;

a voltage biasing means connected to said plurality of pairs of electrodes to tune said dielectric constant of the first plurality of dielectric rods and said dielectric constant of the second plurality of dielectric rods; and said crystal structure having said first and said second sub-crystals stacked to provide a photonic band gap greater than an octave forbidding electromagnetic radiation to propagate perpendicular to said rod axis over a designated frequency band gap.

19. The two-dimensional FTSP selective ultra wideband photonic band gap crystal as recited in claim 18, further comprising:

each of said first plurality of ferroelectric, dielectric rods having a first square cross-sectional dimension, W;

a first constant inter-rod spacing, d, between each of said first plurality of ferroelectric, dielectric rods;

each of said second plurality of ferroelectric, dielectric rods having a second constant square cross-sectional dimension, W/2; and a second constant inter-rod spacing, d/2, between each of said second plurality of ferroelectric, dielectric rods.

20. The two-dimensional FTSP selective ultra wideband photonic band gap crystal as recited in claim 19, further comprising:

a plurality of other crystal structures formed in a manner similar to said first and second sub-crystals; and said crystal structure having said first, second and plurality of other sub-crystals stacked.

21. The two-dimensional FTSP selective ultra wideband photonic band gap crystal as recited in claim 20, further comprising connecting said crystal structure to an antenna circuit and a signal generating means to provide a monolithic ultra wideband antenna.

22. The two-dimensional FTSP selective ultra wideband photonic band gap crystal as recited in claim 21, wherein said signal generating means is an ultra wideband generator achieving an ultra wideband response.

23. The two-dimensional FTSP selective ultra wideband photonic band gap crystal as recited in claim 21, wherein said antenna is a spiral antenna with a plurality of equiangular arms.

24. The two-dimensional FTSP ultra wideband photonic band gap crystal as recited in claim 20, wherein said crystal structure is a filter.

25. The two-dimensional FTSP selective ultra wideband photonic band gap crystal as recited in claim 20, further comprising said first and second plurality of ferroelectric, dielectric rods each having a rectangular cross-section.

26. A three-dimensional FTSP ultra wideband photonic band gap crystal comprising:

a first plurality of ferroelectric, dielectric zigzag pieces, having at least eighteen dielectric zigzag pieces with a minimum of three repeating units, each of said first plurality of ferroelectric, dielectric zigzag pieces having a plurality of upper notches, a plurality of lower notches, the same dimensions, a dielectric constant, four sides and a thin layer of conductive material on two of said sides;

a second plurality of ferroelectric, dielectric zigzag pieces, having at least eighteen dielectric zigzag pieces with a minimum of three repeating units, each of said second plurality of ferroelectric, dielectric zigzag pieces having a plurality of upper notches, a plurality of lower notches, said same dimensions, a dielectric constant, four sides and said thin layer of conductive material on two of said sides;

a plurality of pairs of electrodes being attached to said sides of the first and second plurality of ferroelectric, dielectric zigzag pieces having said thin layer of conductive material;

said plurality of upper notches and lower notches of the first and second plurality of ferroelectric, dielectric zigzag pieces being coated with an insulating material on the interior surfaces of each of said notches;

said first and second plurality of dielectric zigzag pieces being orthogonally interconnected into a first lattice;

said first lattice, being diamond-patterned and disposed within a host material, forms a first sub-crystal structure;

a third and fourth plurality of ferroelectric, dielectric zigzag pieces, each having at least eighteen dielectric zigzag pieces with a minimum of three repeating units, each of said third and fourth plurality of ferroelectric, dielectric zigzag pieces having a plurality of upper notches, a plurality of lower notches, a dielectric constant, four sides, said thin layer of conductive material on two of said sides and a set of identical dimensions differing from said same dimensions of the first and second plurality of dielectric zigzag pieces;

said plurality of pairs of electrodes being attached to said sides of the third and fourth plurality of ferroelectric, dielectric zigzag pieces having said thin layer of conductive material;

said plurality of upper notches and said plurality of lower notches of the third and fourth plurality of ferroelectric, dielectric zigzag pieces being coated with said insulating material on the interior surfaces of each of said notches;

said third and fourth plurality of dielectric zigzag pieces being orthogonally interconnected into a second lattice;

said second lattice, being diamond-patterned and disposed within said host material, forms a second sub-crystal structure;

a voltage biasing means is connected to said plurality of pairs of electrodes to tune said dielectric constant of the first lattice and said dielectric constant of the second lattice; and said first and said second sub-crystals being aligned in parallel to form a crystal structure; and said crystal structure having said first and said second sub-crystals stacked to provide a wideband photonic band gap crystal exhibiting a common forbidden gap with respect to both TE and TM polarizations and simultaneous selectivity of a plurality of frequency, time, spatial and polarization parameters.

27. The three-dimensional FTSP ultra wideband photonic band gap crystal as recited in claim 26, further comprising:

a plurality of other sub-crystals formed in a manner similar to said first and second sub-crystals; and said crystal structure having said first, second and plurality of other sub-crystals stacked.

28. The three-dimensional FTSP ultra wideband photonic band gap crystal as recited in claim 27, further comprising connecting said crystal structure to an antenna circuit and a signal generating means to provide a monolithic ultra wideband antenna.

29. The three-dimensional FTSP ultra wideband photonic band gap crystal as recited in claim 28, wherein said signal generating means is an ultra wideband generator achieving an ultra wideband response.

30. The three-dimensional FTSP ultra wideband photonic band gap crystal as recited in claim 28, wherein said antenna is a spiral antenna with a plurality of equiangular arms.

31. The three-dimensional FTSP ultra wideband photonic band gap crystal as recited in claim 30, further comprising said first and second diamond-shaped lattices each having 36 ferroelectric, dielectric zigzag pieces with three repeating units.

32. The three-dimensional FTSP ultra wideband photonic band gap crystal as recited in claim 27, wherein said crystal structure is a filter.

33. A method of achieving a two-dimensional ultra wideband photonic band gap comprising the steps of:

placing a first plurality of dielectric rods of the same dimension in parallel rows and columns spaced from each other in a predetermined manner and having a rod axis, to form a first lattice;

disposing said first lattice within a host material to form a first sub-crystal;

placing a second plurality of dielectric rods in parallel rows and columns spaced from each other in a predetermined manner having said rod axis, said second plurality of dielectric rods all having an identical set of dimensions differing from said same dimensions of the first plurality of dielectric rods, to form a second lattice;

disposing said second lattice within said host material to form a second sub-crystal;

aligning said first and said second sub-crystals in parallel to form a crystal structure; and stacking said first and second sub-crystals of the crystal structure to provide a wideband photonic band gap for TE waves, an electric field parallel to said first and second plurality of dielectric rods, propagating normal to said rod axis and a band gap for TM waves smaller than said wideband photonic band gap.

34. The method of achieving a two-dimensional ultra wideband photonic band gap as recited in claim 33, further comprising:

each of said first plurality of dielectric rods having a first square cross-sectional dimension, W;

having a first constant inter-rod spacing, d, between each of said first plurality of dielectric rods;

each of said second plurality of dielectric rods having a second constant square cross-sectional dimension, W/2; and having a second constant inter-rod spacing, d/2, between each of said second plurality of dielectric rods.

35. The method of achieving a two-dimensional ultra wideband photonic band gap as recited in claim 34, further comprising the steps of:

forming a plurality of other sub-crystals formed in a manner similar to said first and second sub-crystals;

stacking said first, second and plurality of other sub-crystals of the crystal structure; and said crystal structure having an octave band gap.

36. The method of achieving a two-dimensional ultra wideband photonic band gap as recited in claim 35, further comprising the step of shaping said first and second plurality of dielectric rods to have a rectangular cross-section.

37. The method of achieving a two-dimensional ultra wideband photonic band gap as recited in claim 35, further comprising the step of connecting said crystal structure to an antenna circuit and a signal generating means to provide a monolithic ultra wideband antenna.

38. The method of achieving a two-dimensional ultra wideband photonic band gap as recited in claim 37, wherein said signal generating means is an ultra wideband generator achieving an ultra wideband response.

39. The method of achieving a two-dimensional ultra wideband photonic band gap as recited in claim 37, wherein said antenna is a spiral antenna with a plurality of equiangular arms.

40. The method of achieving a two-dimensional ultra wideband photonic band gap as recited in claim 35, further comprising the step of shaping said first and said second plurality of dielectric rods to have a circular cross-section.

41. The method of achieving a two-dimensional ultra wideband photonic band gap as recited in claim 35, further comprising the step of shaping said first and said second plurality of dielectric rods to have an elliptical cross-section.

42. The method of achieving a two-dimensional ultra wideband photonic band gap as recited in claim 35, wherein said crystal structure is a filter.

43. A method of achieving a three-dimensional ultra wideband photonic band gap comprising:

forming a first plurality of dielectric zigzag pieces having at least eighteen dielectric zigzag pieces with a minimum of three repeating units, each of said first plurality of dielectric zigzag pieces having a plurality of upper notches, a plurality of lower notches and the same dimensions;

forming a second plurality of dielectric zigzag pieces having at least eighteen dielectric zigzag pieces with a minimum of three repeating units, each of said second plurality of dielectric zigzag pieces having a plurality of upper notches, a plurality of lower notches and said same dimensions;

orthogonally interconnecting said first and second plurality of dielectric zigzag pieces being into a first lattice;

disposing said first lattice, being diamond-patterned, within a host material, forming a first sub-crystal structure;

constructing a second lattice, being diamond-patterned, from a third and fourth plurality of dielectric zigzag pieces, each having a plurality of upper notches, a plurality of lower notches and a set of identical dimensions differing from said same dimensions of the first and second plurality of dielectric zigzag pieces;

said third and fourth plurality of dielectric zigzag pieces, each having at least eighteen dielectric zigzag pieces with a minimum of three repeating units, being orthogonally interconnected into a second lattice;

disposing said second lattice, being diamond-patterned, within said host material, forming a second sub-crystal structure;

aligning said first and said second sub-crystals in parallel to form a crystal structure; and stacking said first and second sub-crystals of the crystal structures to provide a wideband photonic band gap crystal exhibiting a common forbidden gap with respect to both TE and TM polarizations.

44. The method of achieving a three-dimensional ultra wideband photonic band gap as recited in claim 43 further comprising the steps of:

forming a plurality of other sub-crystals in a manner similar to said first and second sub-crystals; and stacking said first, second and plurality of other sub-crystals of the crystal structure.

45. The method of achieving a three-dimensional ultra wideband photonic band gap as recited in claim 44, further comprising the step of connecting said crystal structure to an antenna circuit and a signal generating means to provide a monolithic ultra wideband antenna.

46. The method of achieving a three-dimensional ultra wideband photonic band gap as recited in claim 45, wherein said signal generating means is an ultra wideband generator achieving an ultra wideband response.

47. The method of achieving a three-dimensional ultra wideband photonic band gap as recited in claim 45, wherein said antenna is a spiral antenna with a plurality of equiangular arms.

48. The method of achieving a three-dimensional ultra wideband photonic band gap as recited in claim 47, further comprising the step of forming said first and second diamond-shaped lattices to each have 36 dielectric zigzag pieces with three repeating units.

49. The method of achieving a three-dimensional ultra wideband photonic band gap as recited in claim 44 wherein said crystal structure is a filter.

50. A method of achieving a two-dimensional FTSP selective ultra wideband photonic band gap comprising the steps of:

forming a first plurality of ferroelectric, dielectric rods being rectangularly shaped, having the same dimensions, a dielectric constant and a thin layer of conductive material on two sides;

attaching a plurality of pairs of electrodes to said sides of the first plurality of ferroelectric, dielectric rods having said thin layer of conductive material;

placing said first plurality of ferroelectric, dielectric rods in parallel rows and columns spaced from each other in a predetermined manner having a rod axis, forming a first lattice;

disposing said first lattice within a host material forming a first sub-crystal;

forming a second plurality of ferroelectric, dielectric rods, each being rectangularly shaped, having an identical set of dimensions, a dielectric constant and a thin layer of conductive material on two sides;

attaching said plurality of pairs of electrodes to said sides of the second plurality of ferroelectric, dielectric rods having said thin layer of conductive material;

placing said second plurality of ferroelectric, dielectric rods in parallel rows and columns spaced from each other in a predetermined manner having said rod axis, said identical set of dimensions differing from said same dimensions of the first plurality of ferroelectric, dielectric rods, forming a second lattice;

attaching said plurality of pairs of electrodes to said sides of the second plurality of ferroelectric, dielectric rods having said thin layer of conductive material;

disposing said second lattice within said host material forming a second sub-crystal;

aligning said first and said second sub-crystals in parallel forming a crystal structure;

connecting a voltage biasing means to said plurality of pairs of electrodes to tune said dielectric constant of the first plurality of dielectric rods and said dielectric constant of the second plurality of dielectric rods; and stacking said first and said second sub-crystals of the crystal structure to provide a photonic band gap greater than an octave forbidding electromagnetic radiation to propagate perpendicular to said rod axis over a designated frequency band gap.

51. The method of achieving a two-dimensional FTSP selective ultra wideband photonic band gap as recited in claim 50, further comprising:

each of said first plurality of ferroelectric, dielectric rods having a first square cross-sectional dimension, W;

having a first constant inter-rod spacing, d, between each of said first plurality of ferroelectric, dielectric rods;

each of said second plurality of ferroelectric, dielectric rods having a second constant square cross-sectional dimension, W/2; and having a second constant inter-rod spacing, d/2, between each of said second plurality of ferroelectric, dielectric rods.

52. The method of achieving a two-dimensional FTSP selective ultra wideband photonic band gap as recited in claim 51, further comprising the steps of:

forming a plurality of other sub-crystals in a manner similar to said first and second sub-crystals; and stacking said first, second and plurality of other sub-crystals of the crystal structure.

53. The method of achieving a two-dimensional FTSP selective ultra wideband photonic band gap as recited in claim 52, further comprising the step of shaping said first and second plurality of ferroelectric, dielectric rods to have a rectangular cross-section.

54. The method of achieving a two-dimensional FTSP selective ultra wideband photonic band gap as recited in claim 52, further comprising the step of connecting said crystal structure to an antenna circuit and a signal generating means to provide a monolithic ultra wideband antenna.

55. The method of achieving a two-dimensional FTSP selective ultra wideband photonic band gap as recited in claim 54, wherein said signal generating means is an ultra wideband generator achieving an ultra wideband response.

56. The method of achieving a two-dimensional FTSP selective ultra wideband photonic band gap as recited in claim 54, wherein said antenna is a spiral antenna with a plurality of equiangular arms.

57. The method of achieving a two-dimensional FTSP selective ultra wideband photonic band gap as recited in claim 52, wherein said crystal structure is a filter.

58. A method of achieving a three-dimensional FTSP ultra wideband photonic band gap comprising the steps of:

forming a first plurality of ferroelectric, dielectric zigzag pieces, having at least eighteen ferroelectric, dielectric zigzag pieces with a minimum of three repeating units, each of said first plurality of ferroelectric, dielectric zigzag pieces having a plurality of upper notches, a plurality of lower notches, the same dimensions, a dielectric constant, four sides and a thin layer of conductive material on two of said sides;

forming a second plurality of ferroelectric, dielectric zigzag pieces, having at least eighteen ferroelectric, dielectric zigzag pieces with a minimum of three repeating units, each of said second plurality of ferroelectric, dielectric pieces having a plurality of upper notches, a plurality of lower notches, said same dimensions, a dielectric constant, four sides and said thin layer of conductive material on two of said sides;

attaching a plurality of pairs of electrodes to said sides of the first and second plurality of ferroelectric, dielectric zigzag pieces having said thin layer of conductive material;

coating the interior surfaces of said plurality of upper notches and said plurality of lower notches of the first and second plurality of ferroelectric, dielectric zigzag pieces with an insulating material;

orthogonally interconnecting said first and second plurality of dielectric zigzag pieces into a first lattice;

disposing said first lattice, being diamond-patterned, within a host material, forming a first sub-crystal structure;

forming a third and fourth plurality of ferroelectric, dielectric zigzag pieces, each having a plurality of upper notches, a plurality of lower notches, a dielectric constant, four sides, said thin layer of conductive material on two of said sides and a set of identical dimensions differing from said same dimensions of the first and second plurality of dielectric zigzag pieces;

attaching said plurality of pairs of electrodes to said sides of the third and fourth plurality of ferroelectric, dielectric zigzag pieces having said thin layer of conductive material;

coating the interior surfaces of said plurality of upper notches and said plurality of lower notches of the third and fourth plurality of ferroelectric, dielectric zigzag pieces with said insulating material;

orthogonally interconnecting said third and fourth plurality of dielectric zigzag pieces into a second lattice, said third and fourth plurality of dielectric zigzag pieces having at least eighteen ferroelectric, dielectric zigzag pieces with a minimum of three repeating units;

disposing said second lattice, being diamond-patterned, within said host material, forming a second sub-crystal structure;

connecting a voltage biasing means to said plurality of pairs of electrodes to tune said dielectric constant of the first lattice and said dielectric constant of the second lattice;

aligning said first and said second sub-crystals in parallel to form a crystal structure; and stacking said first and second sub-crystals of the crystal structure to provide a wideband photonic band gap crystal exhibiting a common forbidden gap with respect to both TE and TM polarizations and simultaneous selectivity of a plurality of frequency, time, spatial and polarization parameters.

59. The method of achieving a three-dimensional FTSP selective ultra wideband photonic band gap as recited in claim 58, further comprising the steps of:

forming a plurality of other sub-crystals in a manner similar to said first and second sub-crystals; and stacking said first, second and plurality of other sub-crystals of the crystal structure.

60. The method of achieving a three-dimensional FTSP selective ultra wideband photonic band gap as recited in claim 59, further comprising the step of connecting said crystal structure to an antenna circuit and a signal generating means to provide a monolithic ultra wideband antenna.

61. The method of achieving a three-dimensional FTSP selective ultra wideband photonic band gap as recited in claim 60, wherein said signal generating means is an ultra wideband generator achieving an ultra wideband response.

62. The method of achieving a three-dimensional FTSP selective ultra wideband photonic band gap as recited in claim 60, wherein said antenna is a spiral antenna with a plurality of equiangular arms.

63. The method of achieving a three-dimensional FTSP selective ultra wideband photonic band gap as recited in claim 62, further comprising forming said first and second diamond-shaped lattices to each have 36 ferroelectric, dielectric zigzag pieces with three repeating units.

64. The method of achieving a three-dimensional FTSP selective ultra wideband photonic band gap as recited in claim 59, wherein said crystal structure is a filter.

* * * * *

UNITED STATES PATENT AND TRADEMARK OFFICE

CERTIFICATE OF CORRECTION

PATENT NO : 5,739,796

DATED : Apr. 14, 1998

INVENTOR(S) : Louis J. Jasper, Jr., Lawrence Carin, K. Ming Leung

It is certified that error appears in the above-identified patent and that said Letters Patent is hereby corrected as shown below:

Title page, item [54]
and Col. 1, line 3, change "BAD" to read --BAND--.

Column 1, line 3, change "BAD" to read --BAND--;

column 5, line 44, change "FIG. 8" to read --FIG. 3--;

column 7, line 35, change "9.5" to read --8.5--;

column 11, line 61, change "0.0008" to read --0.0009--;

column 15, line 10, delete "an";

column 15, line 35, change "FIG. 7" to read --FIG. 3--.

Signed and Sealed this

Twenty-third Day of November, 1999

*Attest:*

Q. TODD DICKINSON

*Attesting Officer*

*Acting Commissioner of Patents and Trademarks*